US012492884B2

(12) United States Patent
Davis et al.

(10) Patent No.: US 12,492,884 B2
(45) Date of Patent: Dec. 9, 2025

(54) ACCESSORY MOUNT SYSTEM

(71) Applicant: Exponential Innovation IP Holdings LLC, Freehold, NJ (US)

(72) Inventors: Von Davis, Freehold, NJ (US); Daniel R. Blackburn, Jacksonville, FL (US)

(73) Assignee: Exponential Innovation IP Holdings LLC, Freehold, NJ (US)

( * ) Notice: Subject to any disclaimer, the term of this patent is extended or adjusted under 35 U.S.C. 154(b) by 14 days.

(21) Appl. No.: 18/079,536

(22) Filed: Dec. 12, 2022

(65) Prior Publication Data

US 2023/0184517 A1 Jun. 15, 2023

Related U.S. Application Data

(60) Provisional application No. 63/288,690, filed on Dec. 13, 2021.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 3,707,606 A 12/1972 Crespel
4,742,636 A * 5/1988 Swan ..... F41G 11/006 42/126
7,062,876 B2 * 6/2006 Wilson ..... F41G 11/001 42/138
7,827,724 B1 * 11/2010 Spinelli ..... F41G 11/003 248/295.11
8,156,678 B2 * 4/2012 Hoel ..... F41G 11/003 42/124
8,393,104 B1 * 3/2013 Moody ..... F41C 27/00 42/71.01
8,407,925 B2 * 4/2013 Fesas ..... F41A 3/66 42/75.01

(Continued)

OTHER PUBLICATIONS

WBP Picatinny Rail Rear Sight block, Arms of America—Military Imports https://armsofamerica.com/newpicatinny-rail-rear-sight-block/. Retrieved on Dec. 15, 2022, pp. 1-3.

(Continued)

*Primary Examiner* — Michelle Clement
(74) *Attorney, Agent, or Firm* — Lerner David LLP

(57) ABSTRACT

An accessory mount system for connection to a rear sight block (RSB) of a Kalashnikov pattern firearm includes a locking insert that has a projection which extends in a first direction. The projection is adapted to be received within a first recess of the RSB for connection thereto. An adapter body is connected to the locking insert and has a projection that extends in a second direction opposite the first direction. The projection of the adapter body is adapted to be received within a second recess of the RSB for connection thereto. A mount body is connected to the adapter body and has an accessory interface which is adapted to connect to an accessory. An adapter body is secured with a push-pivot pin securely wedging the projection of the adapter against an internal wall of the RSB.

20 Claims, 23 Drawing Sheets

(56) References Cited

U.S. PATENT DOCUMENTS

| | | | | |
|---|---|---|---|---|
| 8,707,606 | B2 * | 4/2014 | Hoel | F41G 11/003 42/124 |
| 9,052,163 | B2 * | 6/2015 | Weigand | F41G 11/001 |
| 9,068,801 | B1 * | 6/2015 | Stecher, Jr. | F41G 11/00 |
| 9,151,575 | B2 * | 10/2015 | Pereira | F41C 23/12 |
| 9,857,147 | B2 * | 1/2018 | Drummond | F41G 11/003 |
| 10,598,464 | B2 * | 3/2020 | Faifer | F41G 11/004 |
| 10,816,309 | B2 * | 10/2020 | Martindale | F41A 5/24 |
| 10,837,737 | B1 * | 11/2020 | Wright | F41G 1/08 |
| 11,105,586 | B2 * | 8/2021 | Tayon | F41G 1/35 |
| 2005/0039369 | A1 * | 2/2005 | Wilson | F41G 11/001 42/124 |
| 2007/0271834 | A1 * | 11/2007 | Keng | F41G 11/003 42/124 |
| 2010/0263256 | A1 * | 10/2010 | Spinelli | F41G 11/003 42/124 |
| 2012/0131838 | A1 * | 5/2012 | Edge | F41G 11/006 42/90 |
| 2013/0074394 | A1 * | 3/2013 | Larue | F41G 1/28 42/111 |
| 2013/0219766 | A1 * | 8/2013 | Lee | F41G 11/003 42/90 |
| 2014/0090286 | A1 * | 4/2014 | Kupanoff | F41G 11/003 42/127 |

OTHER PUBLICATIONS

Samson Manufacturing CORPAK-47 Rear Sight Rail | Brownells, https://www.brownells.com/rifle-parts/sights/sight-parts/rear-sight-bases/ak-47-rear-sight-rail-prod41209.aspx. Retrieved on Dec. 15, 2022, 1 page.

AK Rear Sight Mount—Mount Bases -Firearms Accessories—Clawgear, https://www.clawgear.com/en/AKRear-Sight-Mount-18904en1555/. Retrieved on Dec. 15, 2022, pp. 1-2.

BDM 1—Bitty Dot Mount for Micro Dot Sights, https://www.texasweaponsystems.com /product-p/36101.htm. Retrieved on Dec. 15, 2022, pp. 1-2.

AK Sight Rail, https://www.mountsplus.com/ak-sight-rail.html. Retrieved on Dec. 15, 2022, pp. 1-2.

AK-47 Dust Cover Rail | On Sale https://www.mountsplus.com/ak47-dust-cover-rails.html. Retrieved on Dec. 15, 2022, pp. 1-3.

AK-47 Rear Sight Rail [On Sale] https://www.mountsplus.com/samson-ak-47-rear-sight-rail.html. Retrieved on Dec. 15, 2022, pp. 1-6.

TWS Bitty Dot Mount—AK RMR Mount https://www.mountsplus.com/tws-bittydot-mount-ak-rmr-mount.html. Retrieved on Dec. 15, 2022, pp. 1-4.

* cited by examiner

ACCESSORY MOUNT SYSTEM

CROSS-REFERENCE TO RELATED APPLICATIONS

The present application claims the benefit of the filing date of U.S. Provisional Application No. 63/288,690, filed Dec. 13, 2021, the disclosure of which is hereby incorporated herein by reference.

BACKGROUND OF THE INVENTION

The last few decades have seen an explosion in firearm accessory options. Many of these accessories are mounted to a firearm using one of several different mounting solutions which are usually located on the firearm's handguards or the top of the firearm's receiver where its rear sight is typically located. Some of the more popular accessories include grips, flip-up sights, lights, lasers, and optics, such as thermal, reflex, fixed power, and variable power optics, for example. Some of these accessories, such as sights, optics, and lasers, require calibration after they are mounted to the firearm to ensure that certain features thereof align with the projectile's flight at one or more preselected points along its trajectory. This calibration process is commonly referred to as "zeroing." Once the accessory is properly calibrated to its desired zero, it is important that the mounting solution be stable and sturdy so that the accessory maintains its zero even in extreme conditions. In addition, it is desirable that the mounting solution allows the accessory to be removed for storage, maintenance, and/or exchange with another accessory and later reattached to the firearm without losing its original zero even after the firearm itself is disassembled and reassembled for routine maintenance.

While various mounting solutions have been developed over the years that achieve these objectives with various levels of results, a simple and highly effective solution for Kalashnikov-pattern firearms remains elusive. The Kalashnikov family of firearms may be the most ubiquitous in the world and includes various models of rifles, pistols, shotguns, and machine guns, such as the AK-47, AKM, AK-74, Saiga-12, PP-19 Bizon, and RPK, for example. However, the base design of Kalashnikov-pattern firearms predates the firearm accessory revolution by over half a century and is not well adapted for such accessories or their various mounting options. Such incompatibility is further compounded by the fact that, while the base design of the Kalashnikov-pattern firearms is present across the entire spectrum of variants, many of the variants differ with respect to certain dimensions which has, in the past, rendered precision solutions commercially unfeasible particularly for customers that are not gunsmiths or have access to one. Therefore, further improvements are desirable.

BRIEF SUMMARY OF THE INVENTION

The present disclosure describes accessory mount systems, their exemplary devices, and methods of assembly. Such systems are adapted to accommodate a multitude of different accessories, such as optics, lights, sights, and lasers, for example. In addition, these systems generally connect to a rear sight block (RSB) of a variety of magazine fed Kalashnikov-pattern firearms thereby providing a stable platform that is tied to the firearm's barrel to help mitigate drift of a particular accessory's zero after calibration.

The exemplary accessory mount systems of the present disclosure generally include a direct mount system, universal modular system, and bridge system. The direct mount system generally includes a locking insert, mount adapter, and hardware. The mount adapter of the direct mount system includes an adapter body and a mount body which are integrally connected to each other to form a monolithic structure. The adaptor body preferably minimizes the surface contact with the RSB to reduce heat transfer via thermal conduction into sensitive accessories (e.g., optics or electrical devices) in such a way that the structural integrity is not compromised. Reduction in thermal conduction is achieved through various means where appropriate, such as linear/line contact as opposed to surface contact, reduced cross-sectional area surface contact, undercuts and stand-offs for convection air-gap clearance, and selective engagement or datum locations of the mating parts to create an arduous path of heat flow, for example. The mount body includes an accessory interface adapted to connect to a firearm accessory while the adapter body is configured to connect to the RSB and locking insert which itself connects to the RSB. Thus, the direct mount system generally includes at least two offset locations of connection to the RSB which allows the system to be firmly secured to the RSB alone. The firearm can be easily disassembled without the need to disassemble the accessory mount system. The accessory interface can include Picatinny Rails, a reflex or holographic optic mounting pattern (e.g., RMR®, Docter®, and Aimpoint®, and Shield® patterns), scope rings, and other dedicated mounts for lasers, optics, or lights.

The direct mount system and universal modular system can be provided as a standard kit, enhanced kit, and/or gunsmithing kit. The standard kit includes hardware, a standard mount adapter, and a locking insert. The enhanced kit includes an enhanced mount adapter, locking insert, and enhanced hardware. The gunsmithing kit includes gunsmithing hardware with either the standard or enhanced mount adapter, locking insert, and hardware. Exemplary standard hardware described herein includes flat head screws, a shoulder bolt, push pivot pin, and micro front sight post. Exemplary enhanced hardware includes the standard hardware with the addition of minute of angle shims (MOA) for adjusting the MOA elevation of a mount adapter. The gunsmithing kit hardware includes screws (e.g., set screws and flat head screw), a dowel pin, and drilling guide. These features are considered gunsmithing hardware in that, to deploy their use, it generally requires machining of the underlying firearm. However, the locking inserts and mount adapters are already configured to accommodate such hardware should an operator decide to take advantage of this option. It is noted that the hardware described in this disclosure is exemplary and should not be considered limiting of the possibilities the systems described herein have to offer.

The universal modular system is like the direct mount system with the general exception that the mount adapter is modular. In other words, the mount body and adapter body of the mount adapter are formed separately and connected together through mechanical, chemical (e.g., adhesive bonds), or other means. In this regard, the adapter body can remain secured to an RSB while the mount body and any accessories mounted to it can be swapped out or stored away.

The bridge system is similar to the modular system in that it includes a mount adapter that has separate adapter and mount bodies. However, the mount body is elongated so that it extends or bridges over the dust cover of the firearm from the RSB. This allows magnified/powered optics to be positioned further to the rear of the firearm in order to obtain the desired eye-relief. In addition, since the mount body extends over the dust cover, the mount body may be connected to the adapter body through a quick-connect mechanism to allow the mount body to be easily and quickly removed from and then reconnected to the adapter body so that the dust cover can be removed for maintenance or otherwise.

BRIEF DESCRIPTION OF THE DRAWINGS

The features, aspects, and advantages of the present invention will become better understood with regard to the following description, appended claims, and accompanying drawings in which:

DETAILED DESCRIPTION

Figure 1A:
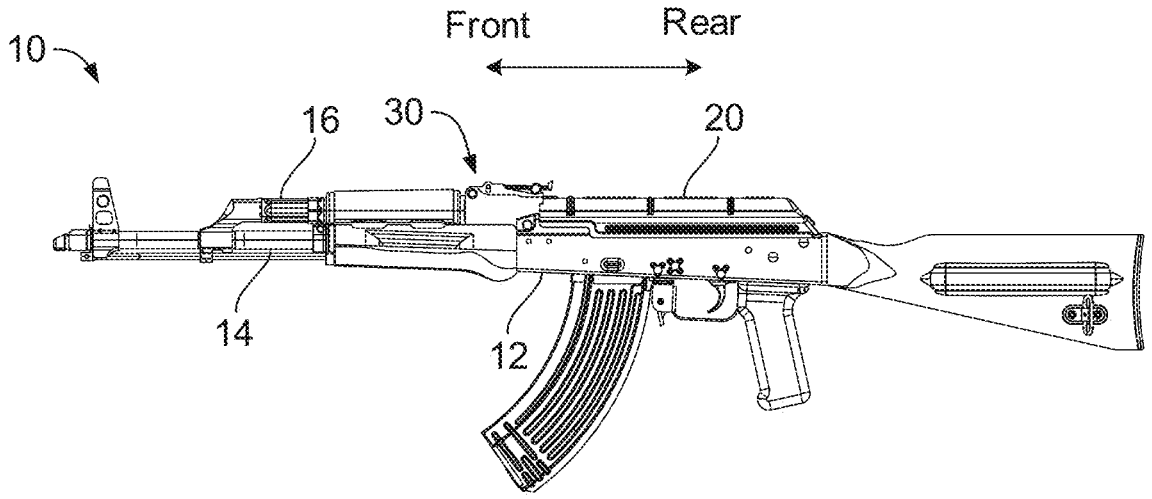
FIG. 1A (PRIOR ART)
FIG. 1A is a side view of a representative Kalashnikov firearm.

FIGS. 1A-1D depict a Kalashnikov-pattern firearm 10, particularly an AK-47. Firearm 10 demonstrates many of the same components commonly found in magazine fed Kalashnikov-pattern firearms including, among other things, a receiver 12, barrel 14, gas tube 16 (partially shown), dust cover 20, rear sight block (RSB) 30, bolt carrier group (not shown), and fire control group (not shown). Receiver 12 houses the bolt carrier group and fire control group while dust cover 20 engages receiver 12 and RSB 30 to cover the components within receiver 12. Barrel 14 and gas tube 16 connect to RSB 30 from its front end while receiver 12 and dust cover 20 abut RSB 30 from its rear end.

Figure 1B:
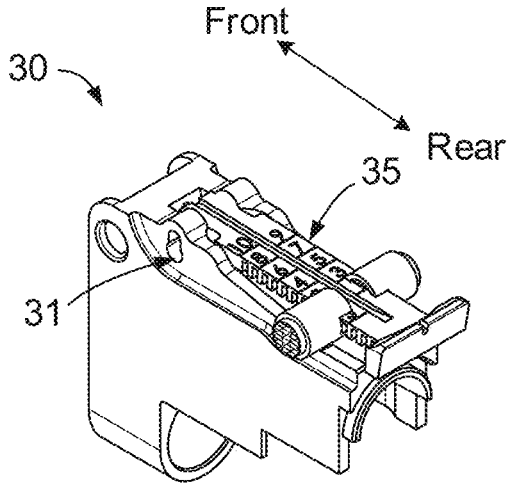
FIG. 1B (PRIOR ART)
FIG. 1B is a perspective view of a rear sight block (RSB) of the Kalashnikov firearm of FIG. 1A.

As shown in FIG. 1B, RSB 30 includes a rear sight assembly 35 which is pivotably connected to a keyhole 31 extending through opposing sidewalls 37*a-b* of RSB 30. Since RSB 30 is connected to barrel 14, usually through a press-fit arrangement, RSB 30 serves as a solid and stable platform for rear sight assembly 35 as there should be little to no movement between barrel 14 and RSB 30. As will be described below, the systems and devices described herein take advantage of the existing structures and stability provided by RSB 30.

Figure 1C:
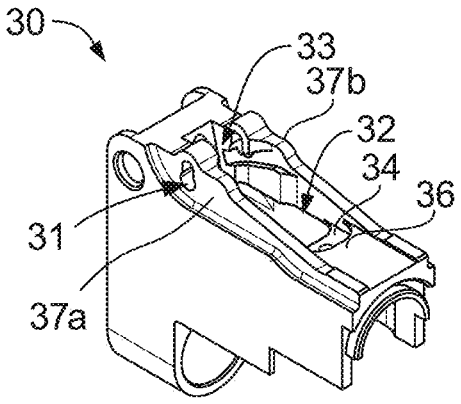
FIG. 1C (PRIOR ART)
FIG. 1C is a perspective view of the RSB of FIG. 1B without a rear sight thereof.
Figure 1D:
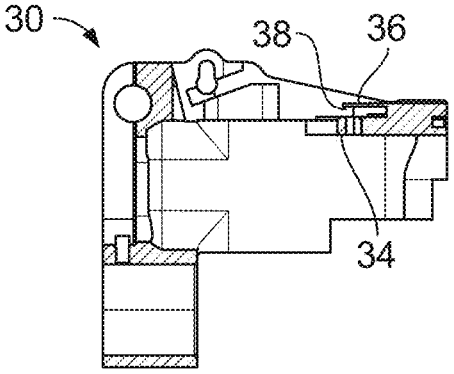
FIG. 1D (PRIOR ART)
FIG. 1D is a cross-sectional side view of the RSB of FIG. 1C taken along a midline thereof.

With rear sight assembly 35 removed, a receptacle 32 of RSB 30 is exposed as shown in FIG. 1C. Sidewalls 37*a-b* extend upward at a front end of RSB 30 to define a front recess or first recess 33 which is in communication with receptacle 32. As such, front recess 33 extends in a top-bottom direction. At the rear side of RSB 30, a top plate 36 extends over a bottom plate 34 which forms a rear recess or second recess 38 between them, as best shown in FIG. 1D. Rear recess 38 extends in a left-right direction. Normally recess 38 receives a leaf spring (not shown) of rear sight assembly 35. However, with such spring removed, recess 38 is exposed. It should be noted that the dimensions of receptacle 32 may differ from variant to variant. For example, a Polish-variant AK-47 may have a smaller receptacle than other AK-47 variants.

FIGS. 2A-13 depict an accessory mount system 100 according to an embodiment of the disclosure. System 100 generally includes a mount adapter 110, locking insert 130, and hardware. System 100 is a direct mount system that can be connected to RSB 30 without gunsmithing. Additionally, as a direct mount system, mount adapter 110 integrates accessory mounting and RSB connection in a unitary or monolithic structure, as described in more detail below.

FIGS. 3A-3E depict a mount adapter 110 according to an embodiment of the present disclosure. Mount adapter 110 generally includes a mount body 112 and an adapter body 120.

Figure 3A:
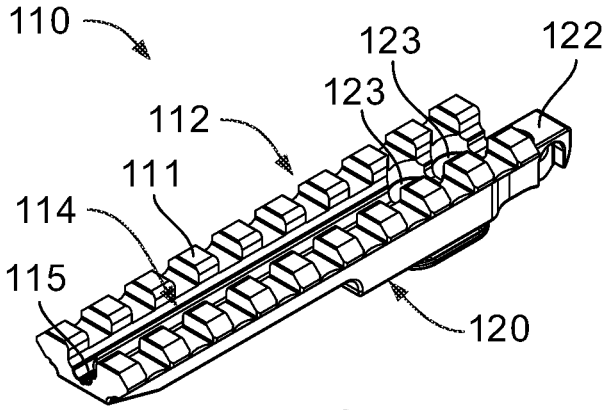
FIG. 3A is top perspective view of a mount adapter of the AMS system of FIG. 2A.
Figure 3B:
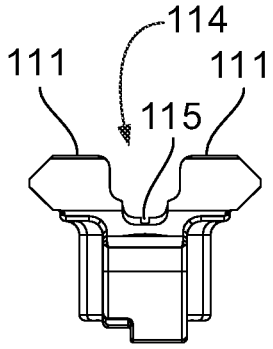
FIG. 3B is front view of the mount adapter of FIG. 3A.
Figure 3C:
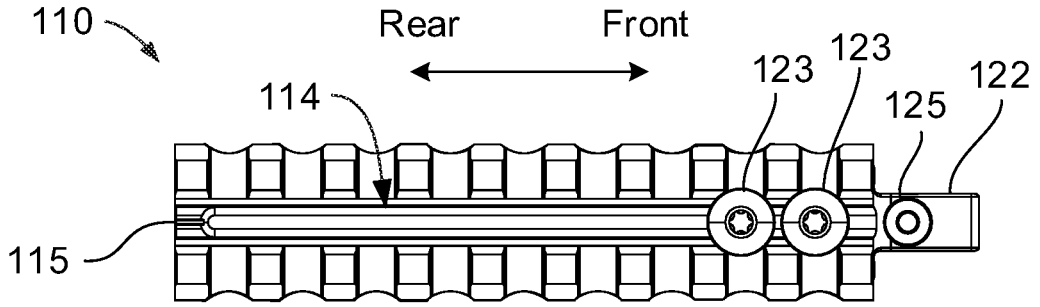
FIG. 3C is a top view of the mount adapter of FIG. 3A.

Mount body or first body 112 includes an accessory interface that is adapted to receive and connect to a variety of accessories, such as sights, optics, lasers, lights, and the like. The accessory interface of mount body 112 is a Picatinny rail which is formed of a plurality of horizontally extending rails 111. As shown in FIGS. 3A-3C, a longitudinal groove or channel 114 extends along the length of mount body 112 bisecting each rail 111. A rear peep notch 115 extends into mount body 112 along channel 114 at a rear end thereof. Also, a pair of smooth bores 123 extend through mount body 112 and intersect channel 114 so that they form counterbores at a front end of channel 114.

Figure 3D:
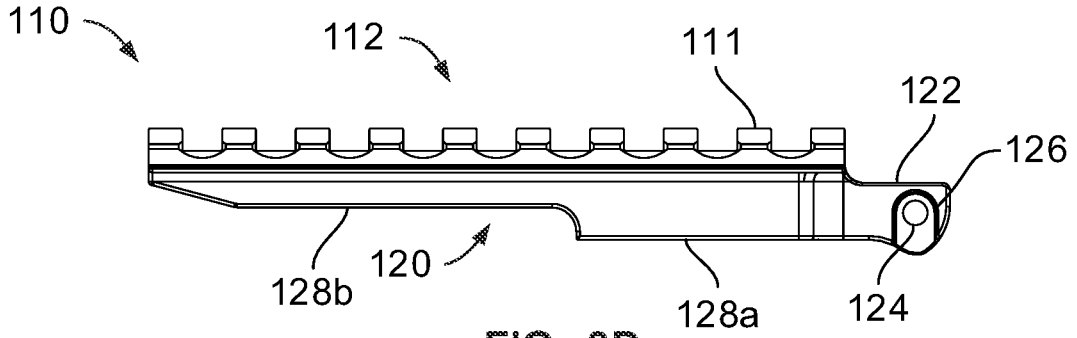
FIG. 3D is a side view of the mount adapter of FIG. 3A.
Figure 3E:
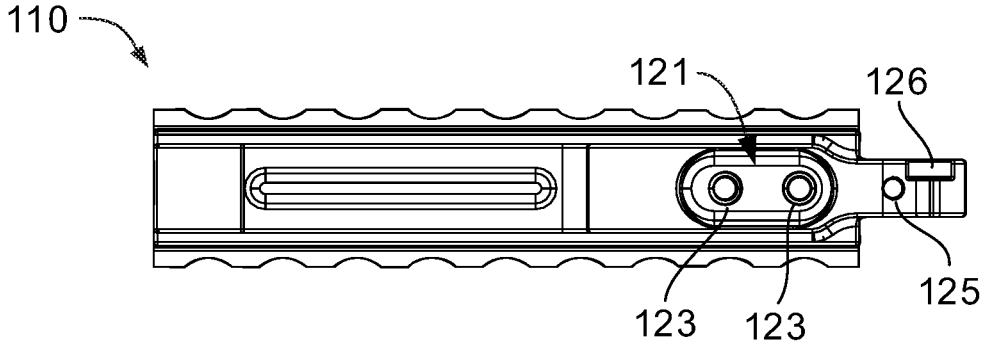
FIG. 3E is a bottom view of the mount adapter of FIG. 3A.

Adapter body 120 is adapted to connect to RSB 30 and is integrally connected to mount body 112 such that they together form a unitary or monolithic structure that is mount adapter 110. In this regard, mount body 112 and adapter body 120 may be manufactured from the same blank of raw material or additively manufactured together as one. However, it is also contemplated that mount body 112 and adapter body 120 may be separately made and then permanently connected via welding or chemical means, such as an adhesive bond, for example. Mount body 112 generally forms at least a portion of a top side of mount adapter 110 while adapter body 120 forms a bottom side. Adapter body 120 includes first and second bottom surfaces 128*a-b*. First and second bottom surfaces 128*a-b* are offset from each other in a top-bottom direction such that first bottom surface 128*a* is the lowest of the two surfaces, as best shown in FIG. 3D. A receptacle 121, as shown in FIG. 3E, extends into first bottom surface 128*a* and has a generally oblong or pill-shape which is configured to receive locking insert 130, as described in more detail below. Smooth bores 123, which extend through mount body 112, also extend through adapter body 120 and intersect receptacle 121. It is contemplated that some embodiments of adapter body 120 may not have a receptacle for insert 130. Instead, bottom surface 128*a* may be a continuous planar surface which just abuts top surface 132 when connected to insert 130.

Adapter body 120 further includes a tang or projection 122 extending in a frontward direction. Tang 122 defines the frontward extent of both adapter body 120 and mount adapter 112. A threaded bore 124 extends through tang 122 in a left-right direction. A side notch 126 extends into tang 122 in a right to left direction and extends about bore 124. Notch 126 runs out the bottom of tang 122 while stopping short of running out the top of tang 122, as shown in FIGS. 3D and 3E. A threaded bore 125 extends into or through tang 122 in a top to bottom direction with a counterbore at the top side of tang 122. As described further below, tang 122 is received within front recess 33 of RSB 30 and can be secured to RSB 30 via hardware.

Figure 4A:
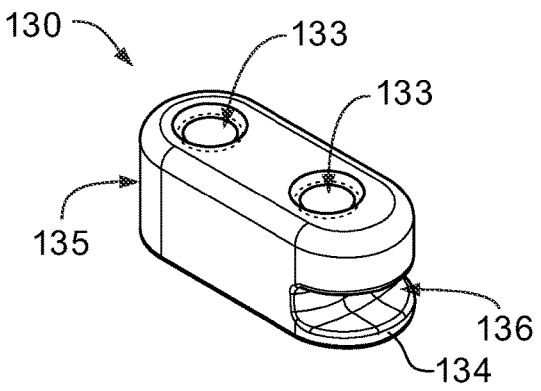
FIG. 4A is a top perspective view of a locking insert of the AMS of FIG. 2A.
Figure 4B:
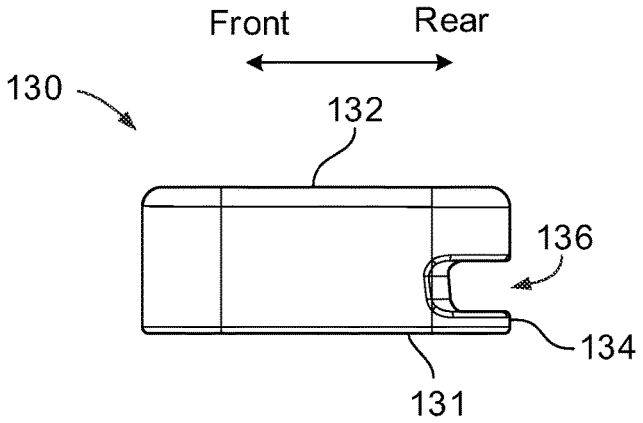
FIG. 4B is a side view of the locking insert of FIG. 4A.

FIGS. 4A and 4B depict locking insert 130 according to an embodiment of the present disclosure. Locking insert 130 includes a body 135 that is oblong or pill-shaped and is dimensioned to be at least partially received within receptacle 32 of RSB 30 and receptacle 121 of adapter body 120. Threaded bores 133 extend into body 135 through a top surface 132 thereof and stops short of a bottom surface 131 of body 130. Bores 133 are aligned with each other in a front-rear direction. A recess or mouth 136 extends into a rear side of body 135 which forms a lip or projection 134 that extends in the rear direction and is generally crescent or semicircular shaped.

The hardware of system 100 includes a plurality of flat head screws 140, a push pivot pin 150, shoulder bolt 160, and micro front sight post 170.

Figure 5:
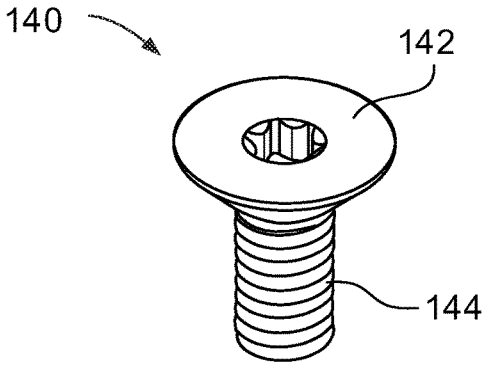
FIG. 5 is a perspective view of a flat head screw of AMS system of FIG. 2A.

FIG. 5 depicts a flat head screw 140 which includes a head 142 and threaded shaft 144. The head 142 is flat so that when it is sunk in a respective smooth bore 123, head 142 will not obstruct an operator's line-of-sight down channel 114.

Figure 6:
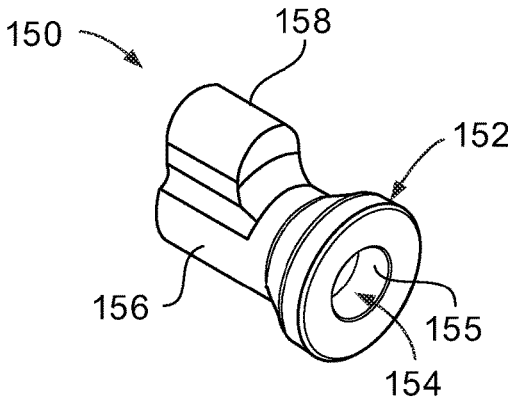
FIG. 6 is a perspective view of a push pivot pin of the AMS of FIG. 2A.

FIG. 6 depicts push pivot pin 150 which includes a head 152, shaft 156, and lobe 158. Shaft 156 extends from head 152, and lobe 158 extends radially outwardly from shaft 156. A smooth bore 154 extends into head 152. The shaft 156 and lobe 158 combination is configured to engage keyhole 31 of RSB 30. Head 152 is generally cylindrical and conically tapers down to shaft 156. Internal face 155 is the conical termination of smooth bore 154 but could also be a flat face. Head 152 is adapted to be received within side notch 126 of tang 122 to help secure tang 122 to RSB 30, as explained further below.

Figure 7:
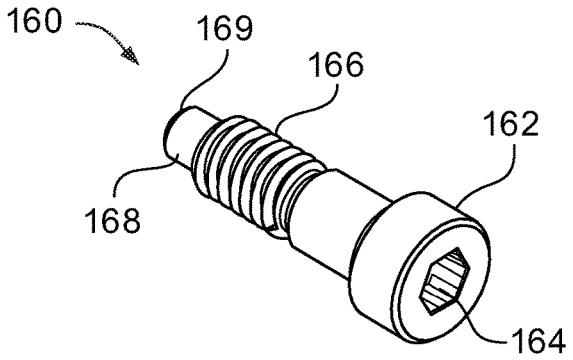
FIG. 7 is a perspective view of a shoulder bolt of the AMS of FIG. 2A.

FIG. 7 depicts shoulder bolt 160 which includes a head 162 with a tool opening 164, threaded shank 166, and an unthreaded blunt tip 168 extending from threaded shank 166 with an end face 169 shown as flat but could also be conical or spherical. Tip 168 is configured to be received within smooth bore 154 of push pivot pin 150 so that it can freely rotate therein. Anti-seize, coating or other lubricant may be applied to tip 168 and face 169 to reduce friction, prevent galling, and ensure proper movement against face 155 of pivot pin 150.

Figure 8A:
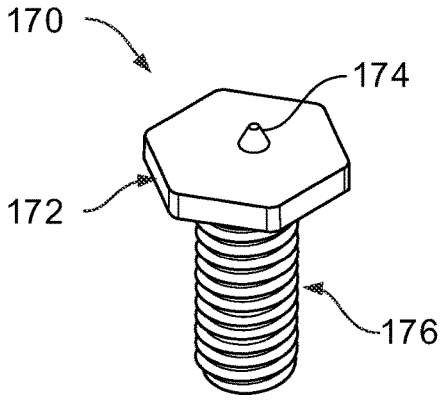
FIG. 8A is top perspective view of a micro front sight post of the AMS of FIG. 2A.
Figure 8B:
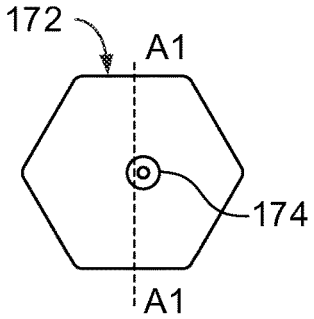
FIG. 8B is a top view of a head of the micro front sight post of FIG. 8A.

FIGS. 8A and 8B depict micro front sight post 170 which includes a head 172, threaded shank 176 extending from head 172 in a first direction, and a tip 174 extending from head 172 in a second direction opposite the first direction. Threaded shank 176 is configured to be received within threaded bore 125 of tang 122. Tip 174 is conically shaped, but may have other shapes, such as cylindrical, for example. As shown in FIG. 8B, tip 174 is eccentrically arranged on head 172 so that rotation of front sight post 170 causes tip 174 to oscillate between opposite sides of an axis A1. Thus, front sight post 170 allows for elevational and windage adjustments simply by rotating front sight post 170 up or down.

Figure 9:
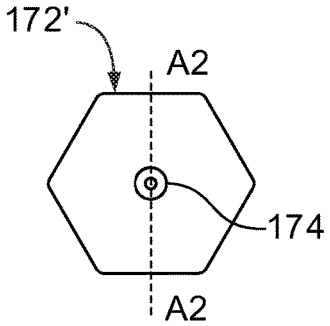
FIG. 9 is a top view of a head of a micro front sight post according to another embodiment of the present disclosure.

FIG. 9 depicts a head 172' of front sight post 170 according to another embodiment of the disclosure. Head 172' differs from head 172 in that tip 174 is symmetrically arranged or centered on head 172' so that an axis A2 always bisects tip 174 as post 170 is rotated. Thus, head 172' allows for elevational adjustments but not windage adjustments.

Figure 10:
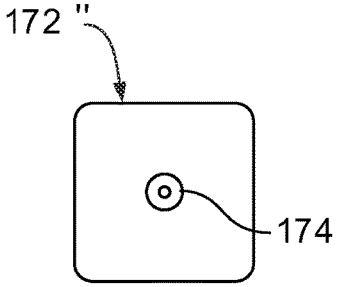
FIG. 10 is a top view of a head of a micro front sight post according to a further embodiment of the present disclosure.

FIG. 10 depicts another head 172". Just like head 172', tip 174 is symmetrically arranged thereon. However, it could be eccentrically arranged like that of head 172. Head 172" is in the shape of a square, whereas heads 172 and 172' are hexagons. Such polygonal shapes allow a tool, such as plyers of a Leatherman tool or a socket wrench, to easily engage and rotate front sight post 170 to make the desired adjustments. Thus, any polygon that facilitates tool engagement may be used for a head of micro front sight post 170.

Figure 11:
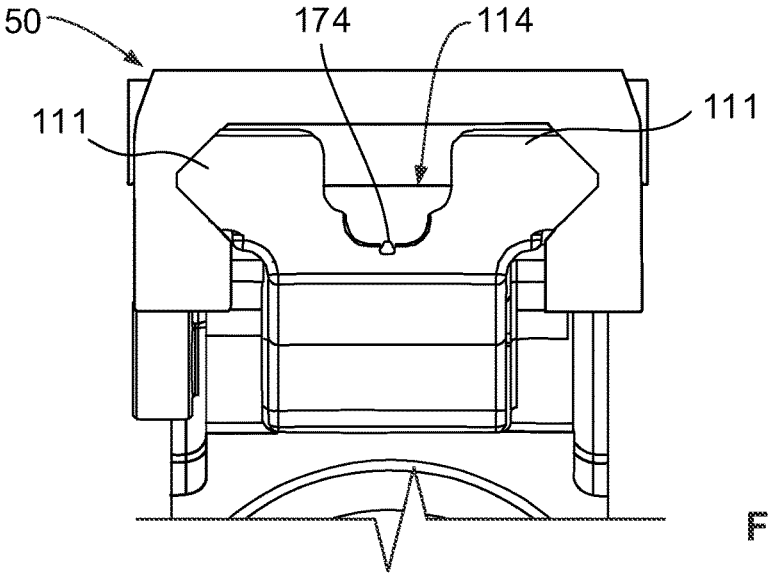
FIG. 11 is a partial rear view of the AMS and RSB of FIG. 2A with an optic mounted to the AMS.

FIG. 11 is an illustration of an exemplary sight picture using micro front sight post 170. As shown, an optic 50 is mounted to the rails 111 of mount body 112. Channel 114 forms a gap through which an operator can gain line of sight of micro front sight post 170 and rear peep notch 115 so that the operator can still take aim in the event the optic 50 is disabled or removed.

Figure 2A:
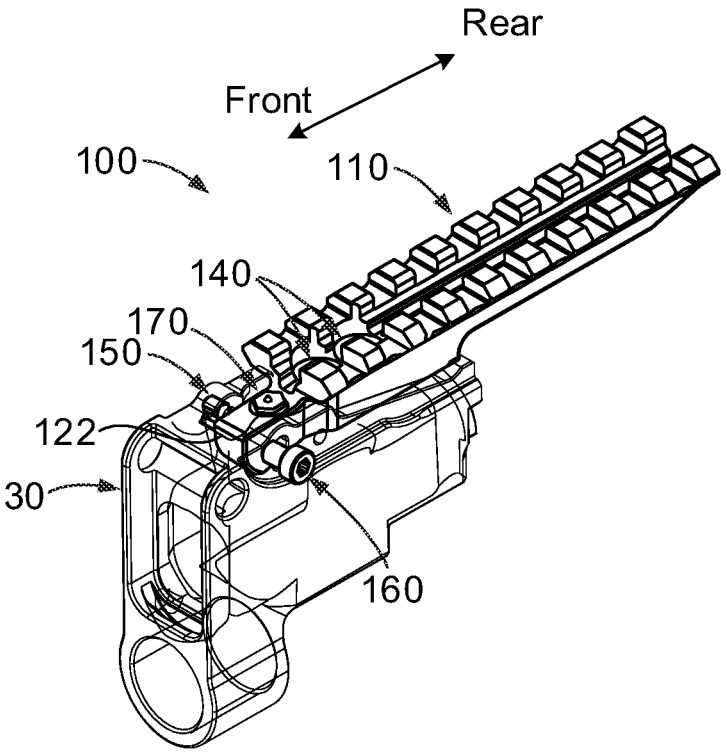
FIG. 2A is a perspective view of an accessory mount system (AMS) according to an embodiment of the present disclosure as assembled with the RSB of FIG. 1C.
Figure 2B:
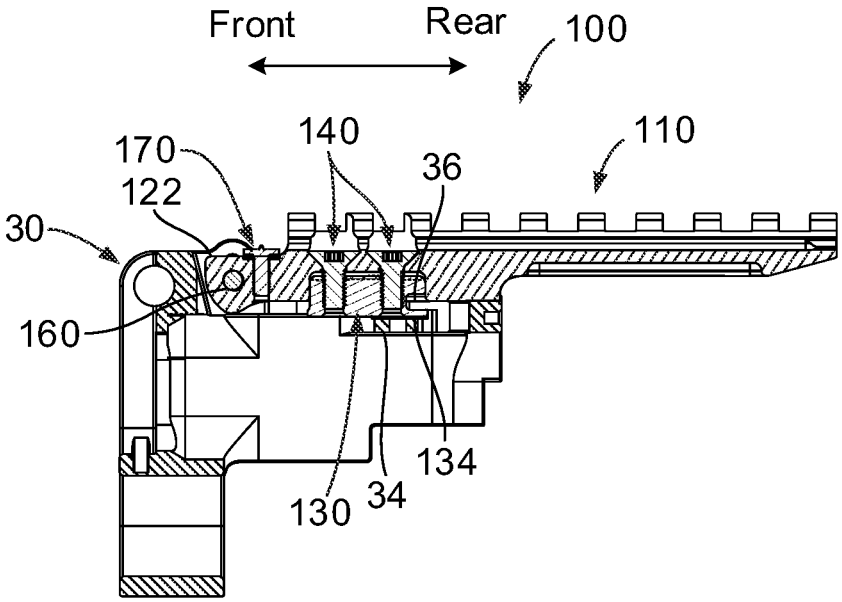
FIG. 2B is a cross-sectional side view of the AMS and RSB of FIG. 2A.

System 100 is connected to RSB 30 of firearm 10 by inserting locking insert 130 into receptacle 32 of RSB 30 so that projection 134 extends into rear recess 38 of RSB 30, as best shown in FIG. 2B. This engagement prohibits locking insert 130 from being pulled upwardly out of receptacle 32 as top plate 36 engages with projection 134 to constrain its axial (pitch) rotation or vertical movement.

Figure 12A:
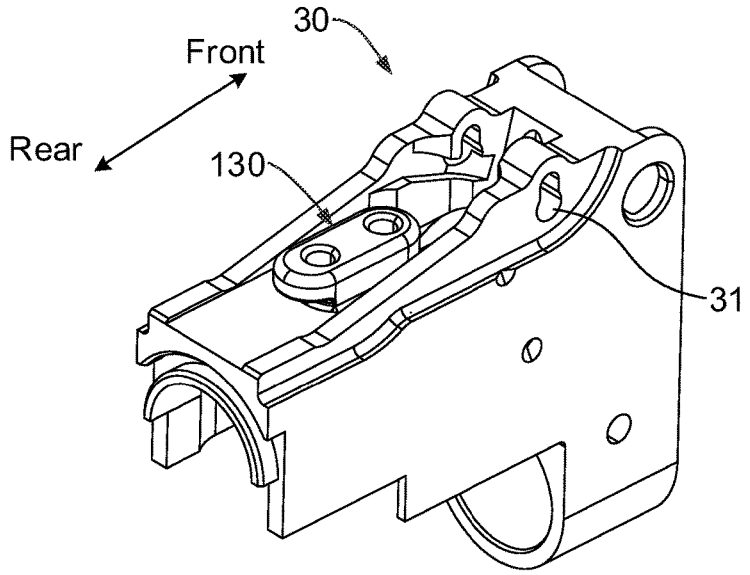
FIG. 12A is a top perspective view of the locking insert of FIG. 4A assembled with the RSB of FIG. 1C.
Figure 12B:
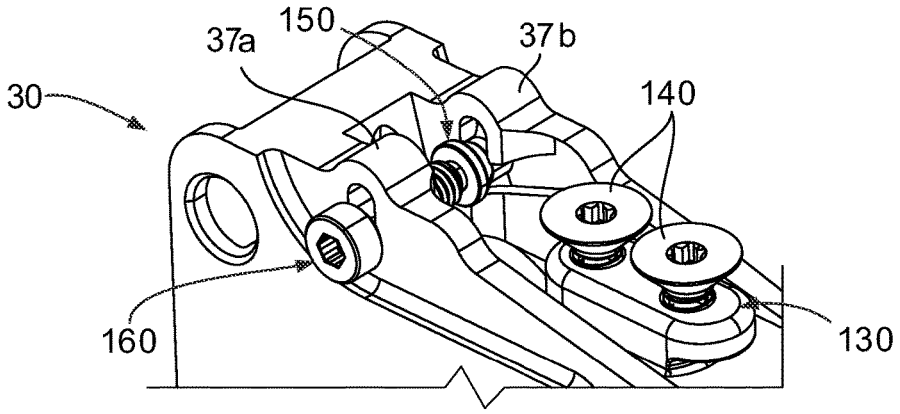
FIG. 12B is a partial top perspective view of the locking insert of FIG. 4A, flat head screw of FIG. 5, push pivot pin of FIG. 6, and shoulder bolt of FIG. 7 assembled with the RSB.
Figure 12C:
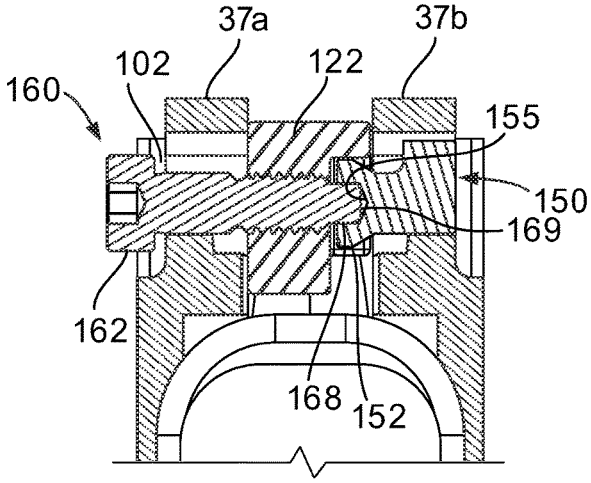
FIG. 12C is cross-sectional forward-facing view of the mount adapter of FIG. 2A, push pivot pin of FIG. 6, and shoulder bolt of FIG. 7 assembled with the RSB.
Figure 13:
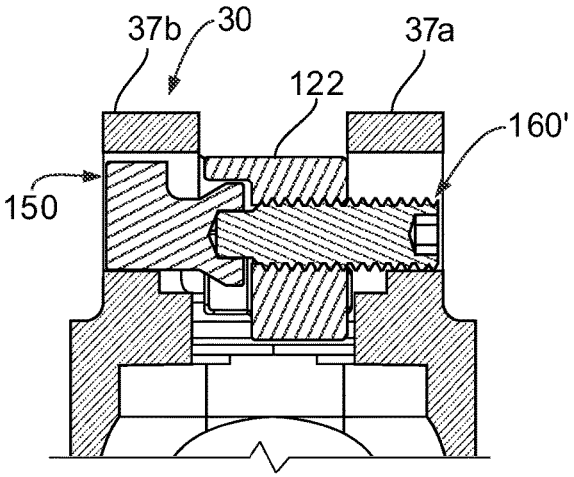
FIG. 13 is a cross-sectional rear-facing view of the mount adapter of FIG. 2A, push pivot pin of FIG. 6, and a dogleg set screw according to an embodiment of the present disclosure assembled with the RSB.

As illustrated in FIGS. 12B and 12C, tang 122 of mount adapter 110 is then inserted into front recess 33 so that bore 124 aligns with keyhole 31. Push pivot pin 150 is inserted into keyhole 31 at a right side of tang 122 so that head 152 is positioned within side notch 126 of tang 122 and then rotated so that lobe 158 locks pivot pin 150 into second sidewall 37*a*. Shoulder bolt 160 is inserted into keyhole 31 at a left side of tang 122 and through bore 124 of tang 122 so that tip 168 of bolt 160 is received within bore 154 of pivot pin 150. Shoulder bolt 160 is then rotated so that, using push pivot pin 150 as leverage, tang 122 of mount adapter 110 is securely locked or wedged in place thereby removing any play from this first connection location of mount adapter 110. In other words, mechanical forces that are generated as the external threaded shank 166 of bolt 160 positively engages the internal threaded bore 124 of mount adapter 110 are transferred from face 169 of bolt 160 to face 155 of pivot pin 150 which drives the tapered head 152 of pivot pin 150 against the internal right-side of keyhole 31 of RSB 30. Since pivot pin 150 is constrained within keyhole 31, the resultant force propels tang 122 of mount adapter 110 in a right-to-left direction until the left face of tang 122 makes intimate contact with the internal left face of recess 33 of sidewall 37*a* of RSB 30 securing it from further movement. As proper torque is applied to bolt 160, the wedge-effect becomes sufficiently strong when combined with the cross-pin action of shaft 166 of bolt 160 and hole 154 of pivot pin 150 which are securely located within key hole 31, as to mechanically arrest five out of the six degrees of mechanical freedom (or motion): vertical translation, forward translation, lateral translation, roll, and yaw, while reducing axial rotation (pitch) with friction. The shaft portion of bolt 160 is sufficiently long as to create an air gap 102, which is formed between first sidewall 37*a* and head 162 to ensure the inboard face of head 162 does not make contact, preventing the bolt 160 from "bottoming out" before mount adapter 110 is properly secured. FIG. 13 shows that the wedging of tang 122 can also be performed by a headless dog leg screw 160' in lieu of shoulder bolt 160. It is conceived that the use of anti-vibration compound, a thread-lock material (such as nylon), a cross-screw, crimping, clinching, swaging, staking, or a combination thereof could be used to ensure bolt 160 does not unintentionally loosen, which would render system 100 insecure.

As shown in FIG. 2B, prior to securing tang 122 to RSB 30 at the first location, mount adapter 110 is rotated about shoulder bolt so that first bottom surface 128*a* contacts top plate 36 of RSB 30, and body 135 of locking insert 130 is received within receptacle 121 extending through first bottom surface 128*a*. Flat head screws 140 are driven through bores 123 of mount adapter 110 and into bores 133 of locking insert 130, as best shown in FIGS. 2B and 12B, thereby securing mount adapter 110 to a second location of RSB 30 and thereby mechanically arresting all degrees of mechanical freedom. In this regard, mount adapter 110 is secured entirely to RSB 30 at multiple locations so that mount adapter 110 extends over dust cover 20 in a cantilevered manner. The clearance formed between first and second bottom surfaces 128*a-b* allows dust cover 20 to be removed without disassembling system 100. An optic, light, laser, or other accessory may be mounted to mount body 112 at any location along its length. Should the optic fail for whatever reason, micro front sight post 170 and peep notch 115 can be used to sight in until the optic is replaced or repaired.

FIGS. 14A-19B depict accessory mount system 200 according to another embodiment of the disclosure. System 200 is a direct mount system like that of system 100. In this regard, system 200 generally includes a mount adapter 210, locking insert 230, and hardware. However, system 200 includes enhancements for adjustments and gunsmithing, as explained below. For ease of review, like elements will be accorded like reference numerals to that of system 100, but within the 200-series of numbers.

FIGS. 15A-15D depict mount adapter 210 for system 200. Mount adapter 210 is like mount adapter 110 in that it includes a mount body 212 with a Picatinny rail accessory interface 211 and an adapter body 220 integrally connected to mount body 212 to form a monolithic mount adapter structure. However, mount adapter 210 includes a third bottom surface 228*c* which is offset from first and second bottom surfaces 228*a-b* and arranged intermediate relative thereto in a top-bottom direction as well as in a front-rear direction. The step-up from first bottom surface 228*a* to third bottom surface 228*c* creates clearance for a shim 290 which allows for finely tuned minute of angle (MOA) adjustments, as explained in more detail below.

Mount adapter 210, unlike mount adapter 110, also includes a third smooth bore 223*c* and a pin bore 227. Third smooth bore 223*c* is similar to first and second smooth bores 223*a-b* as it extends through mount and adapter bodies 212, 220 in a top to bottom direction and is configured to receive flat head screw 140. Also, third smooth bore 223*c* is aligned with first and second bores 223*a-b* in a front-rear direction and similarly intersects channel 214 so that a counterbore of third smooth bore 223*c* is formed in mount body 212. However, unlike first and second smooth bores 223*a-b*, third smooth bore 223*c* does not intersect receptacle 221 and instead extends through third bottom surface 228*c*. Pin bore 227 extends through tang 222 in a left-right direction and is a smooth bore configured to receive a dowel pin 280 (see FIG. 17). Third smooth bore 223*c* and pin bore 227 are gunsmithing options as they facilitate additional securement relative to system 100. However, a gunsmith may need to machine RSB 30 for such corresponding bores 223*c* and 227 to be operable.

Figure 16A:
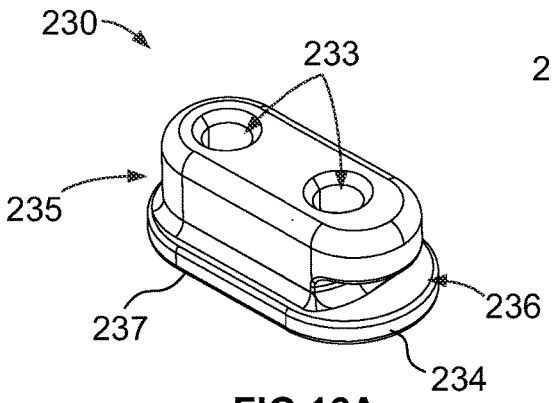
FIG. 16A is a top perspective view of another embodiment of the present disclosure of a locking insert of the AMS of FIG. 14A.
Figure 16B:
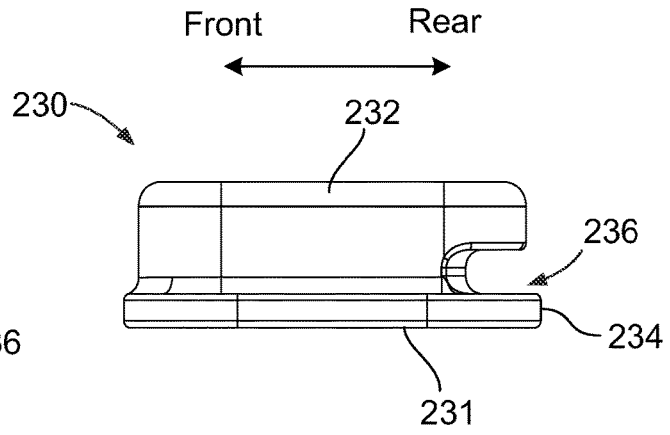
FIG. 16B is a side view of the locking insert of FIG. 16A.

FIGS. 16A and 16B depict locking insert 230 according to another embodiment of the present disclosure. Locking insert 230 is like insert 130 in that it includes a pill-shaped body 235, threaded bores 233, top face 232, bottom face 231, and a lip or projection 234 defined by a rear-side mouth or recess 236. However, unlike insert 130, locking insert 230 includes a flange or skirt 237 extending outwardly from a perimeter of body 235 and at its bottom end. Such skirt 237 is at least partially formed by lip 234 and defines a maximum perimeter of locking insert 230. As previously mentioned, RSB receptacle 32 dimensions may differ depending on the variant of Kalashnikov-pattern firearm. For example, locking insert 130 is adapted to conform to a receptacle 32 of a Polish-variant AK-47, while locking insert 230 is adapted for a variant with a receptacle 32 of larger dimensions. Skirt 237 provides this adaptation while allowing the dimensions of body 235 to remain the same as body 135 so that it can be received within receptacle 121, 221 of mount adapter 120 or mount adapter 220. Thus, inserts 130 and 230 can be used in their specific Kalashnikov variant while being capable of mating with either mount adapter 120, 220. Thus, a multitude of locking inserts like those of inserts 130 and 230 can be produced and optionally provided in a kit to accommodate the various possible RSB receptacle 32 dimensions.

System 200 includes all the hardware of system 100. In this regard, system 200 includes flat head screws 240, push pivot pin 250, shoulder bolt 260, and micro front sight post 270. System 200 may additionally include one or more MOA shims 290, a drill guide bushing 205, and/or a dowel pin 280. A tap bushing guide (not shown) may also be included and is similar to drill guide bushing 205.

Figure 17:
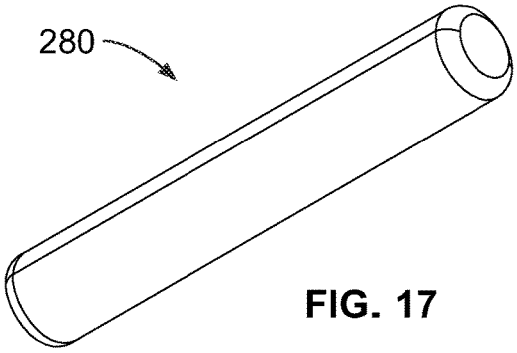
FIG. 17 is a perspective view of a dowel pin of the AMS of FIG. 14A.

FIG. 17 depicts dowel pin 280 which is adapted to be received within pin bore 227 of adapter body 220 for enhanced securement of mount adapter 210 to RSB 30. However, to use dowel pin 280, a gunsmith may have to machine RSB 30 to accommodate dowel pin 280.

Figure 18A:
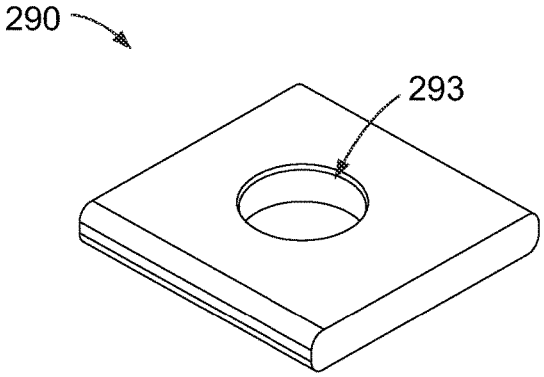
FIG. 18A is a perspective view of a minute of angle (MOA) shim of the AMS of FIG. 14A.
Figure 18B:
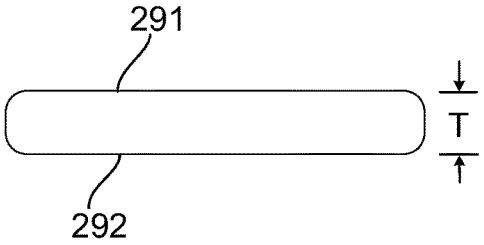
FIG. 18B is a front view of the MOA shim of FIG. 18A.

FIGS. 18A and 18B depict an MOA shim 290 which is generally a flat plate with a thickness (T) defined between top and bottom surfaces 291, 292 thereof. A bore 293 extends through top and bottom surfaces 291 and 292 of MOA shim 290 for receipt of a screw 240*c*. The thickness of shim 290 is calibrated to rotated mount adapter 210 a predefined MOA about a pivot axis defined by shoulder bolt 260 and push pivot pin 250. This provides mount adapter 210 the capability to make elevation adjustments so that an optic mounted thereto can avoid reaching the outer limits of its elevation turret. Multiple MOA shims 290 with incremental thicknesses can be provided in a kit or separately. MOA shims 290 can be provided in increments of 1 MOA, 2, MOA, 5 MOA, 10 MOA, and/or 20 MOA, etc. The present embodiment of MOA shim 290 shows surfaces 291 and 292 as parallel, other embodiments could be non-parallel (or converging wedge shape, shorter at the rear) to improve contact between faces 228*c* of mount adapter 210 and 36 of RSB 30 when higher MOA's are selected.

Figure 19A:
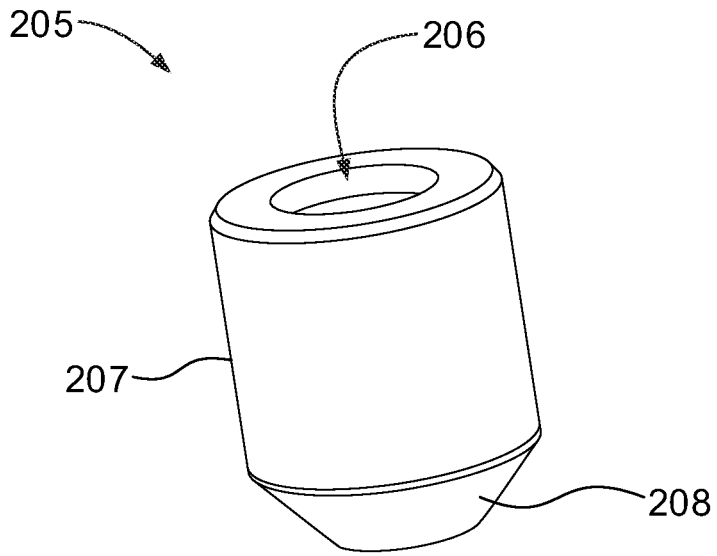
FIG. 19A is a perspective view of a drill guide bushing of the AMS of FIG. 14A.

FIG. 19A depicts a drill guide bushing 205 which can be used to machine top plate 36 of RSB 30 for threaded engagement with a screw 240*c*. Bushing 205 may be made from bronze and includes a conical portion 208, cylindrical portion 207, and a drill bore 206 extending through cylindrical and conical portions 207, 208 for guiding a drill or tap bits therethrough. Drill bore 206 could come in variety of dimensions to accommodate different threaded hole sizes as prescribed by the gunsmith.

Figure 19B:
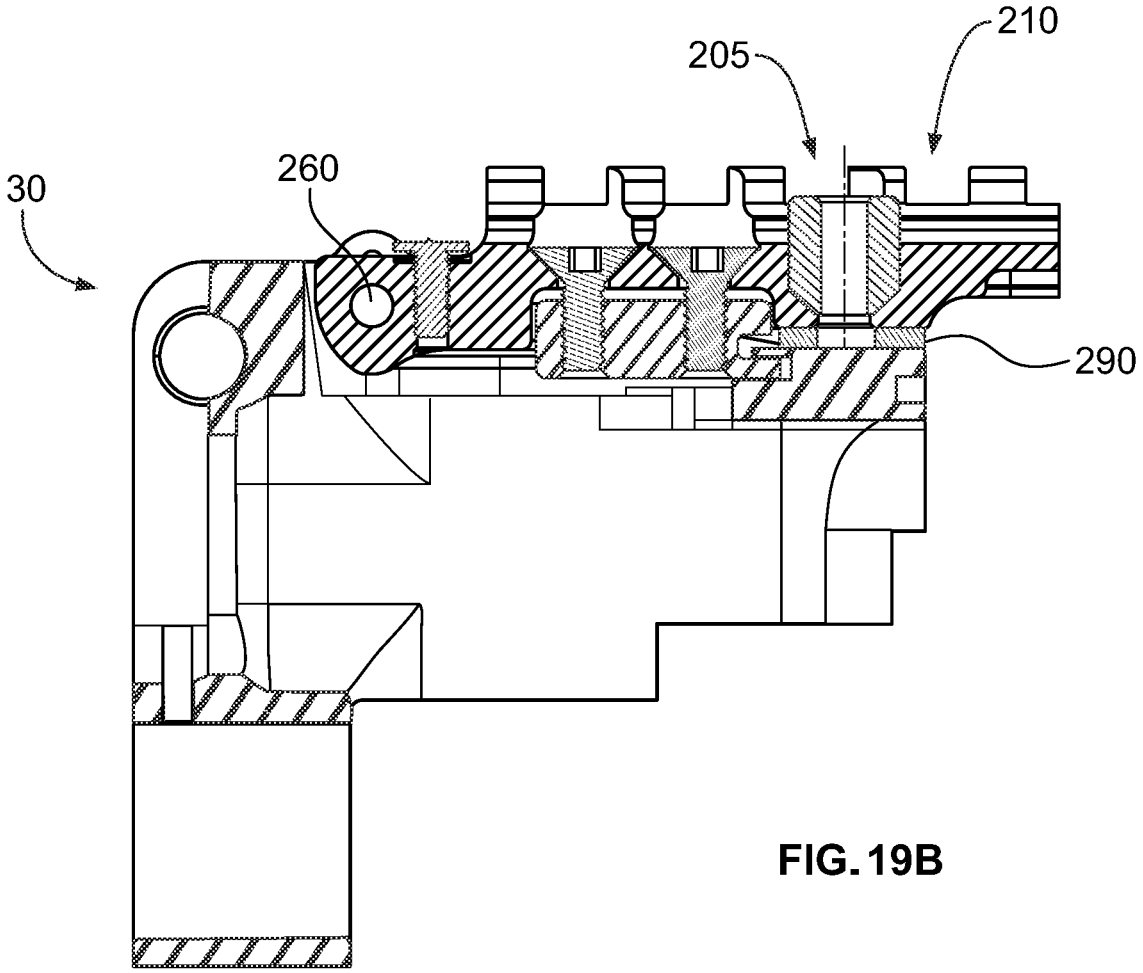
FIG. 19B is a cross-sectional view of the and RSB and AMS with the drill guide bushing of FIG. 19A assembled therewith.

FIG. 19B depicts the use of drill guide bushing 205. Bushing 205 can be placed into third bore 223*c* of mount adapter 210. The conical and cylindrical shapes self-centers guide 205 within bore hole 223*c* and secures it in place so that a drill bit will not shift during operation. Since each MOA shim 290 rotates mount adapter 210 a desired MOA about shoulder bolt 260 and pivot pin 250, it is preferable that the selected MOA shim 290 be placed between top plate 36 of RSB 30 and third bottom surface 228*c* of mount adapter 210 prior to drilling into RSB 30 since the drill axis will be different for each MOA shim 290 used. Thus, drilling through guide 205 without the desired MOA shim 290 in place can cause misalignment of a screw 240*c* driven through bore 223*c*. Drilling through shim 290 is possible because of its clearance bore 293.

Figure 14A:
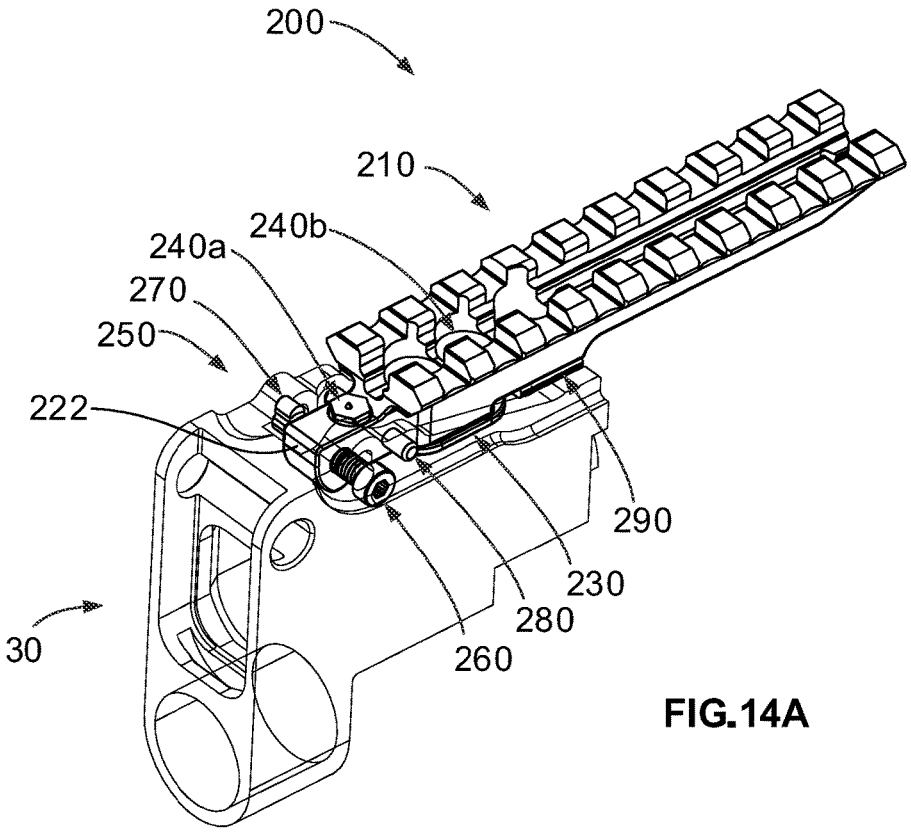
FIG. 14A is a top perspective view of an AMS according to another embodiment of the present disclosure as assembled with the RSB of FIG. 1C.
Figure 14B:
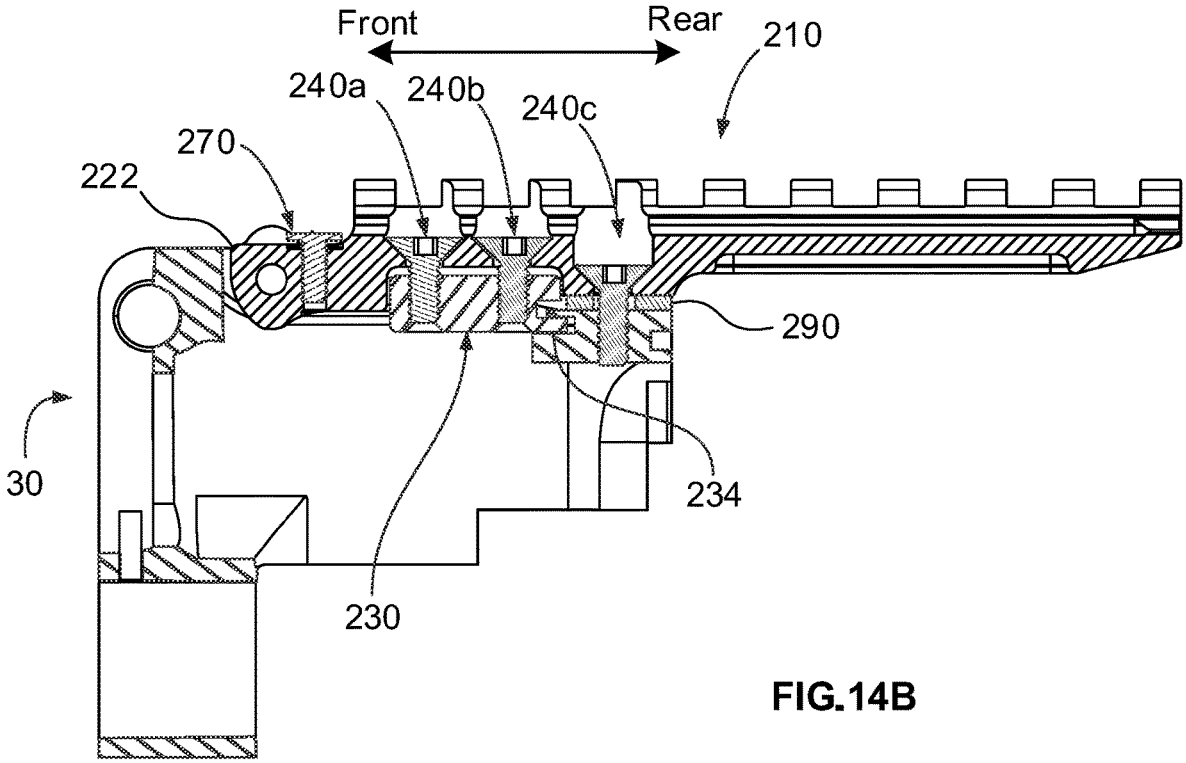
FIG. 14B is a cross-sectional side view of the AMS and RSB of FIG. 14A.
Figure 15A:
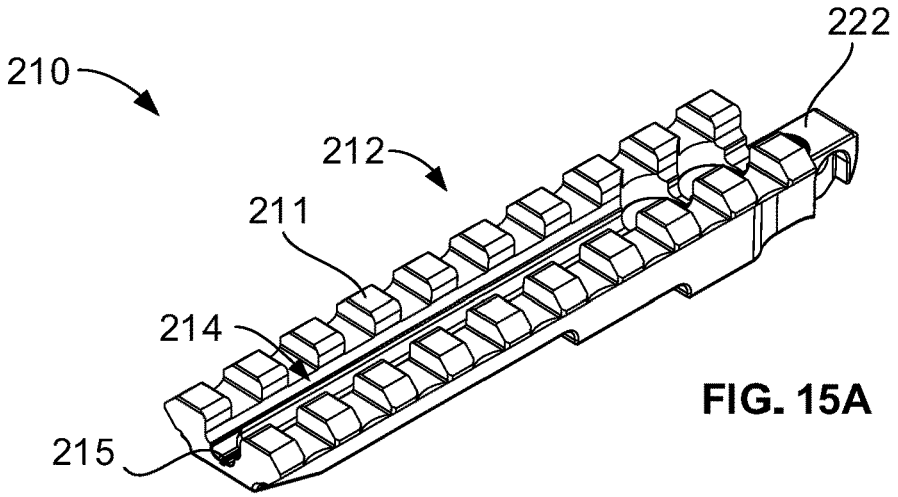
FIG. 15A is a top perspective view of a mount adapter of the AMS of FIG. 14A.
Figure 15B:
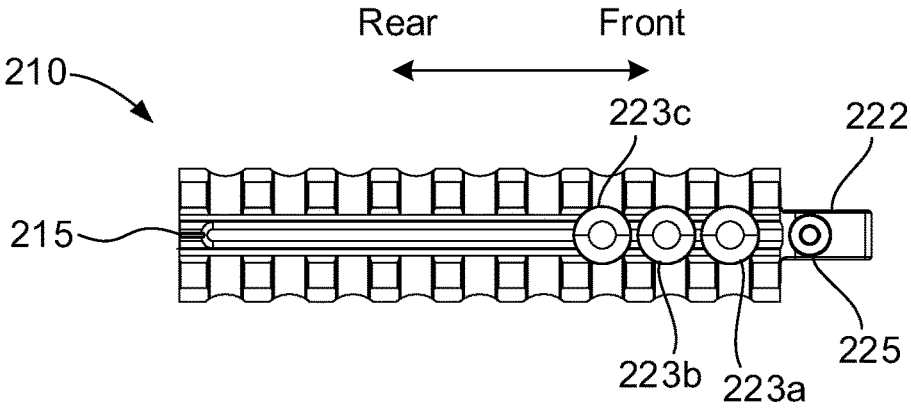
FIG. 15B is top view of the mount adapter of FIG. 15A.
Figure 15C:
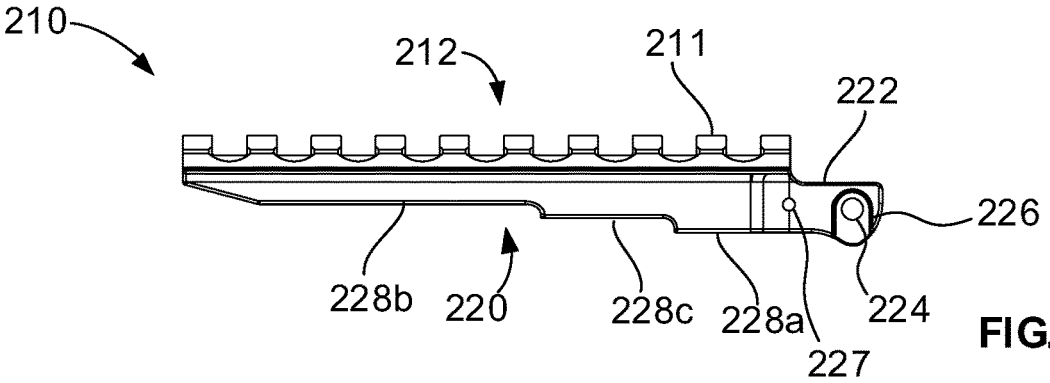
FIG. 15C is a side view of the mount adapter of FIG. 15A.
Figure 15D:
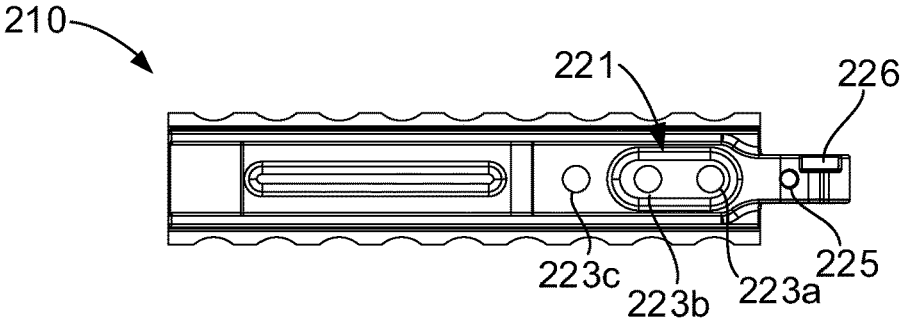
FIG. 15D is a bottom view of the mount adapter of FIG. 15A.

System 200 is connected to RSB 30 of firearm 10 in a similar manner described above with respect to system 100 with the exception that, prior to wedging tang 222 and driving screws 240*a-b* into insert body 230, an MOA shim 290 of a desired thickness is inserted between RSB 30 and adapter body 220. If needed, drill guide bushing 205 may be used as described above to form a threaded hole in RSB 30 in alignment with third bore 223*c* of mount adapter 210. As shown in FIGS. 14A and 14B, a third flat head screw 240*c* is inserted through mount adapter 210 and shim 290 and into RSB 30 which both retains shim 290 and further secures mount adapter 210 at a third location on RSB 30. Dowel pin 280 may also be inserted through RSB 30 and into pin bore 227 of adapter body 220 for an additional location of securement.

Figure 20:
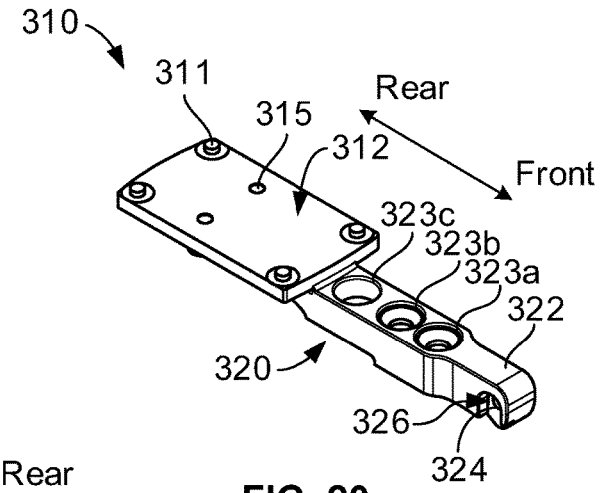
FIG. 20 is a top perspective view of a mount adapter according to another embodiment of the present disclosure.

FIG. 20 depicts a mount adapter 310 according to another embodiment of the present disclosure that can be used in system 100 or 200. Mount adapter 310 is an optic specific adapter that includes an optic specific mount body 312 and an adapter body 320. Similar to mount adapter 110 and 210, mount body 312 and adapter body 320 are integrally connected to form a monolithic structure mount adapter structure. Adapter body 320 has substantially the same features as adapter body 220 including a plurality of smooth bores 323*a-c*, a stepped bottom, receptacle 321, and a tang 322 with a bore 324 and side notch 326. Thus, adapter body 320 is connectable to a locking insert, such as inserts 130 and 230, and RSB 30 in the same manner as previously described.

Mount body 312 is positioned at a rear end of adapter body 320 offset from smooth bores 323*a-c* and is in the form of a plate that has an optic specific interface. Thus, the interface has certain features, such as lugs 311 and bores 315, that are configured to engage corresponding features of a particular optic, such as one a variety of reflex and holographic optics currently available. Additionally, a footprint of mount body 312 is constrained to the specifications of the specific optic to which it is adapted so that it is of minimal size and weight.

Figure 21A:
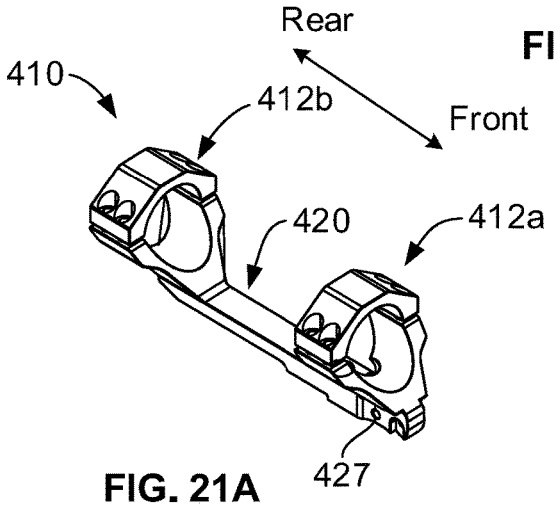
FIG. 21A is a top perspective view of a mount adapter according to a further embodiment of the present disclosure.
Figure 21B:
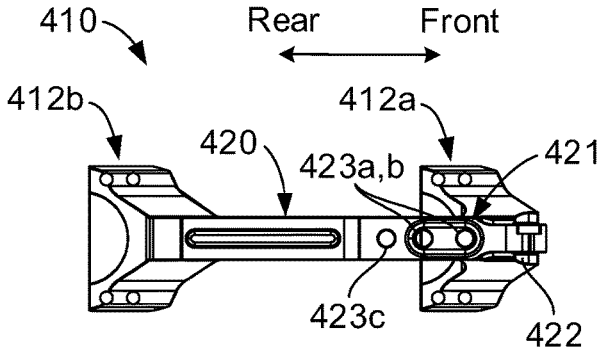
FIG. 21B is a bottom view of the mount adapter of FIG. 21A.

FIGS. 21A-21B depict a mount adapter 410 that can be used in system 100 or 200 according to further embodiment of the present disclosure. Mount adapter 410 is a scope ring adapter that includes first and second mount bodies 412*a-b* extending from an adapter body 420. Similar to mount adapter 110, 210, and 310, mount bodies 412*a-b* and adapter body 420 are integrally connected to form a monolithic structure. The first and second adapter bodies 412*a-b* are in the form of scope rings which can be any standard size ring to accommodate the wide variety of available powered optics. Adapter body 420 has substantially the same features as adapter body 220 including a plurality of smooth bores 423*a-c*, a stepped bottom, bore 427, receptacle 421, and a tang 422. Thus, adapter body 420 is connectable to RSB 30 in the same manner as previously described.

Figure 22A:
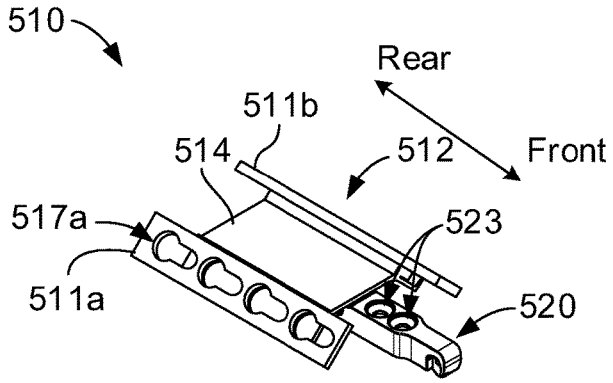
FIGS. 22A and 22B are top perspective views of a mount adapter according to an even further embodiment of the present disclosure.
Figure 22B:
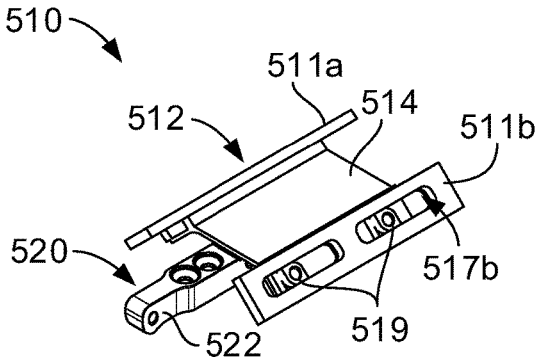

FIGS. 22A-22B depict a mount adapter 510 that can be used in system 100 according to yet another embodiment of the present disclosure. Mount adapter 510 includes a mount body 512 and an adapter body 520. Similar to mount adapter 110, 210, 310, and 410, mount body 512 and adapter body 520 are integrally connected to form a monolithic structure. Adapter body 520 has substantially the same features as mount adapter 110 including a plurality of smooth bores 523, a stepped bottom, and a tang 522. Thus, adapter body 520 is connectable RSB 30 in the same manner as previously described.

Mount body 512 includes an intermediate plate 514 and canted mounting brackets or rails 511*a-b* connected to right and left sides of intermediate plate 514. The cant of brackets 511*a-b* allows for multiple accessories to be mounted to mount adapter 510 at once within a short footprint. It also allows for the accessories to be positioned out of the line of sight of other accessories that may be mounted elsewhere on firearm 10. For example, a reflex optic, holographic optic, or modular iron sights can be mounted to first or second bracket in a canted orientation to serve as a backup to a primary optic which may be mounted elsewhere on firearm. Lasers and lights can also be mounted to mount adapter. As shown, first bracket 511*a* has a first type of accessory interface 517*a*, while second bracket 511*b* includes a second type of accessory interface 517*b*. However, it should be understood that brackets 511*a-b* may both include the same type of accessory interface. The interface 517*a* of first bracket 511*a* in the embodiment depicted is a Keymod®. However, M-Lok®, Picatinny, or other standard interfaces, for example, could be included instead of Keymod®. The interface 517*b* of second bracket in the embodiment depicted includes elongate slots with sliding shuttles 519 engaged to such slots. Additional accessories can be secured to shuttles 519 with a threaded fastener. The ability of shuttles 519 to slide provides adjustability for a multitude of differently configured accessories. Similar offset or canted interface brackets 511 may be integrated into any of the other mount styles such as 100, 200, 300, 400, 600, 700, 800, 900, 1000, etc. either in a detachable or permanent mechanical form.

Figure 23A:
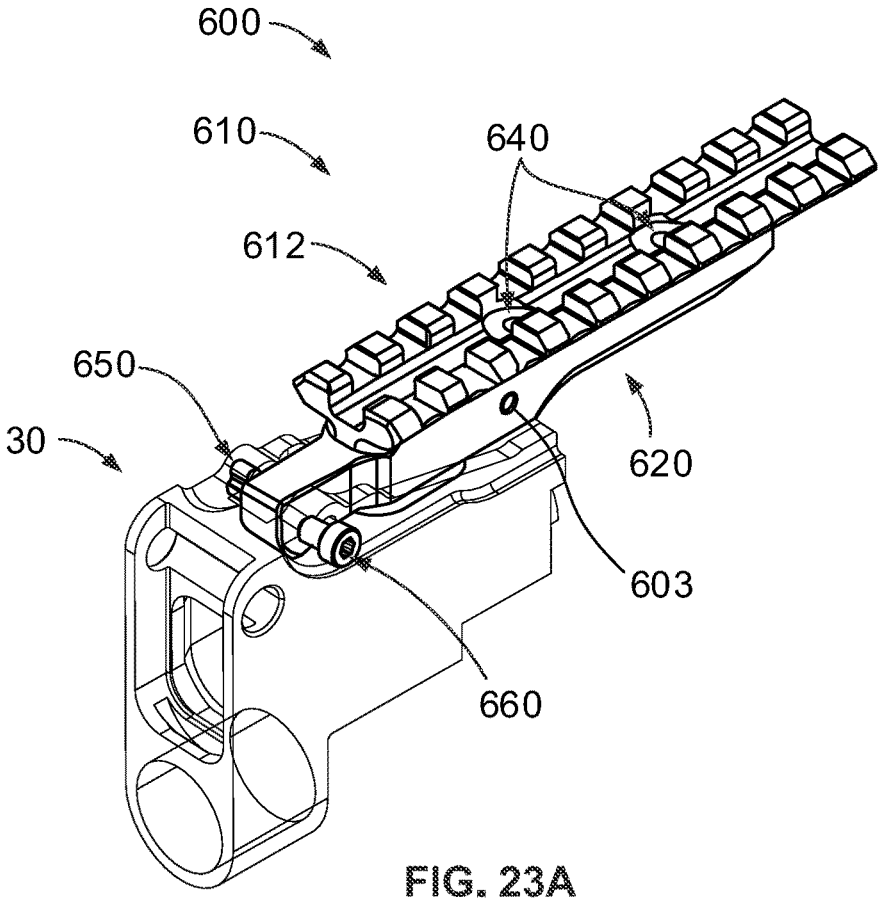
FIG. 23A is a top perspective view of an AMS according to yet another embodiment of the present disclosure as assembled with the RSB of FIG. 1C.
Figure 23B:
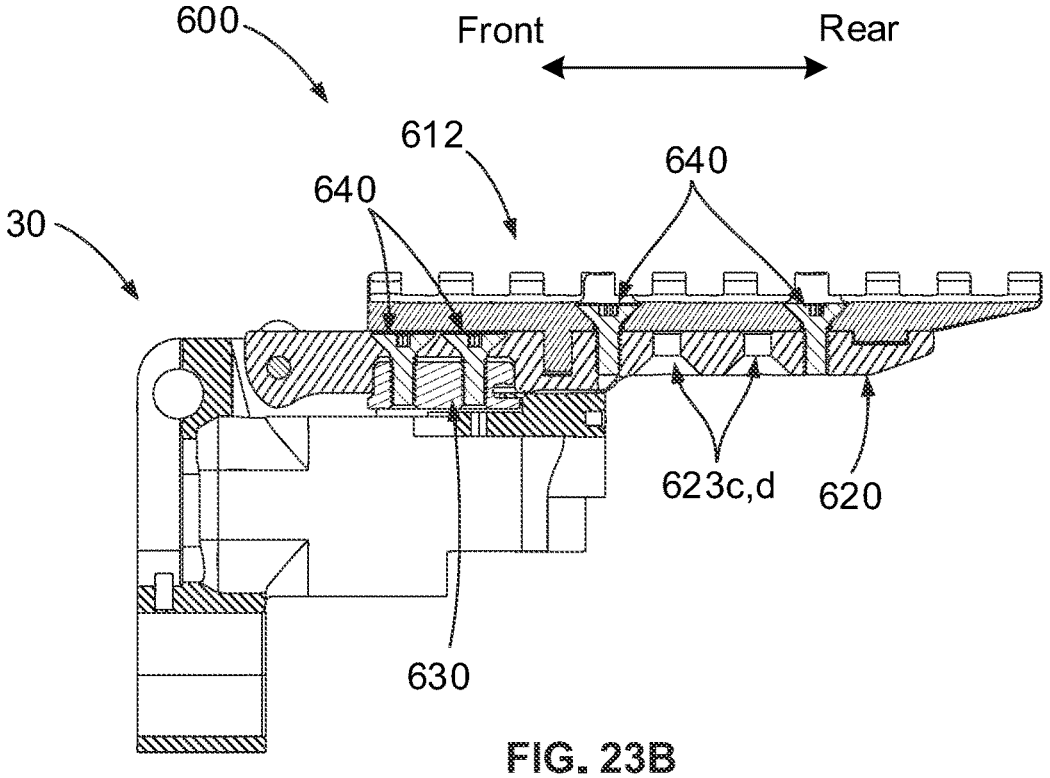
FIG. 23B is a cross-sectional side view of the AMS and RSB of FIG. 23A.

FIGS. 23A-23B depict an accessory mount system 600 according to further embodiment of the disclosure. System 600 is like that of system 100 in that it generally includes a mount adapter 610, locking insert 630, and hardware. However, system 600 is a universal modular system that differs with respect to mount adapter 610 and hardware. In this regard, mount adapter 610 is modular so that its mount body 612 and adapter body 620 are separately formed structures which are joined or connected together to form an integrated structure of at least two separate components that can be assembled and disassembled as desired. Additional hardware facilitates this connection, as described further below. For ease of review, like elements will be accorded like reference numerals to that of system 100, but within the 600-series of numbers.

Mount adapter 610 is like mount adapter 110 in that it includes a mount body 612 and adapter body 620. However, unlike mount adapter 110, mount adapter 610 is modular such that mount body 612 and adapter body 620 are separately formed structures that are joined or connected together through reversible mechanical means to form the integrated structure that is mount adapter 610. Such mechanical means can include, but are not limited to, a threaded fastener, pin, press-fit, snap-fit, heat-shrink fit, taper-lock, dovetail sliding fit, chemical adhesion and the like.

Mount body or first body 612 is like mount body 112 in that it includes an accessory interface that is adapted to receive and connect to a variety of accessories, such as sights, optics, lasers, lights, and the like. In this regard, the accessory interface of mount body 612 is a Picatinny rail 611. While not shown, a rear peep notch like that of peep notch 115 may extend into mount body 612. Also, a pair of smooth bores 613*a-b* extend through mount body 612 and form counterbores in body 612 and are used to secure mount body 612 to adapter body 620 with two additional screws 640 as displayed in FIG. 23B.

Figure 24A:
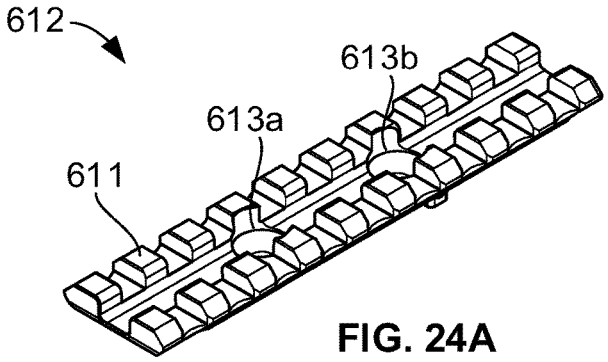
FIG. 24A is a top perspective view of a mount body of the AMS of FIG. 23A.
Figure 24B:
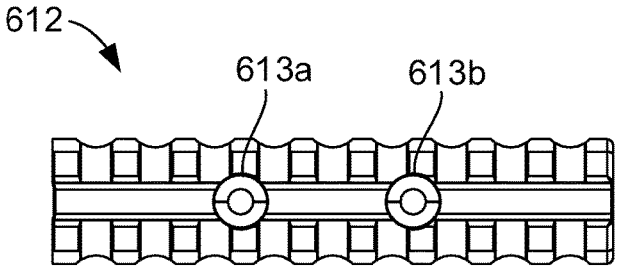
FIG. 24B is a top view of the mount body of FIG. 24A.
Figure 24C:
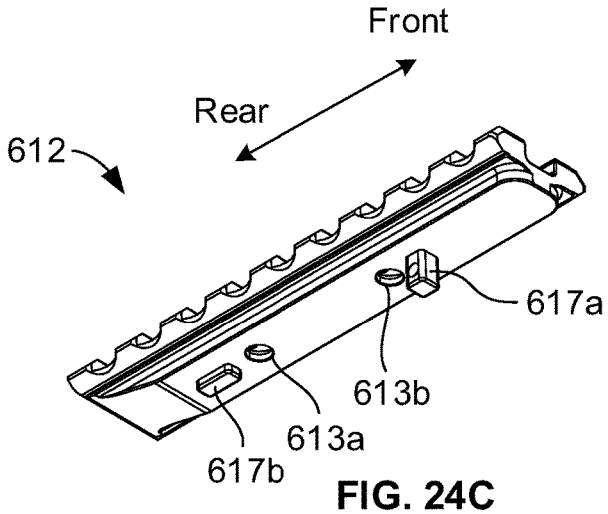
FIG. 24C is a bottom perspective view of the mount body of FIG. 24A.
Figure 24D:
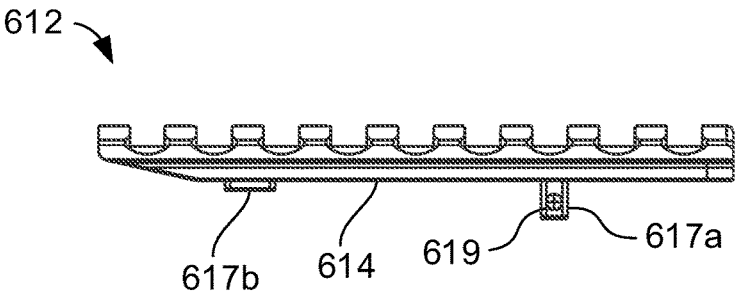
FIG. 24D is a side view of the mount body of FIG. 24A.

However, since mount body 612 is modular, unlike mount body 112, it includes connection features that help it accomplish connection with adapter body 620 in addition to first and second smooth bores 613*a-b*. As shown in FIGS. 24C and 24D, such connection features, include a first boss or lug 617*a* and a second boss or lug 617*b* which extend from a bottom surface 614 of mount body 612. First lug 617*a* is located closer to the front end of mount body 612 than second lug 617*b*. First and second lugs 617*a-b* are both rectangular. However, the longest dimension of first lug 617*a* is its height, whereas the longest dimension of second lug 617*b* is its frontward-backward length. First rectangular lug 617*a* also includes indentations or cups 619 on opposed right and left sides thereof for engagement with two conical-tipped set screws 603 (see FIG. 23A).

Figure 25A:
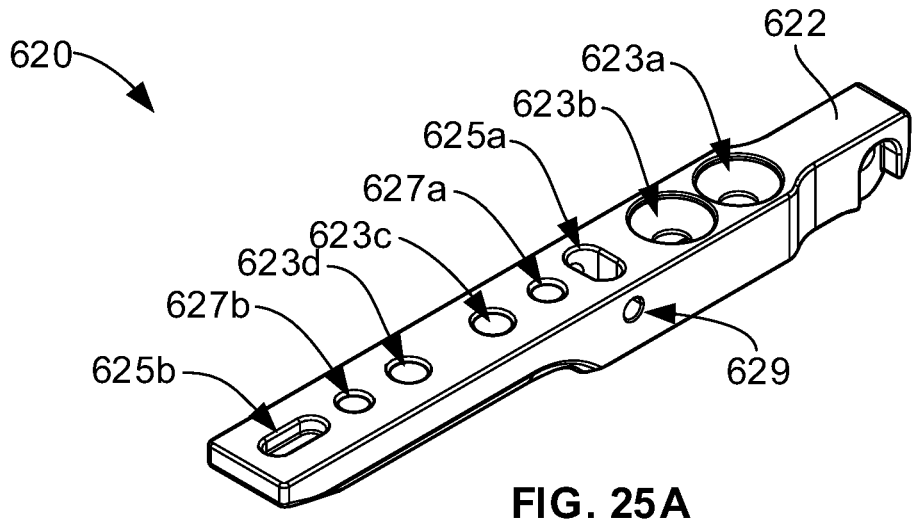
FIG. 25A is a top perspective view of an adapter body of the AMS of FIG. 23A
Figure 25B:
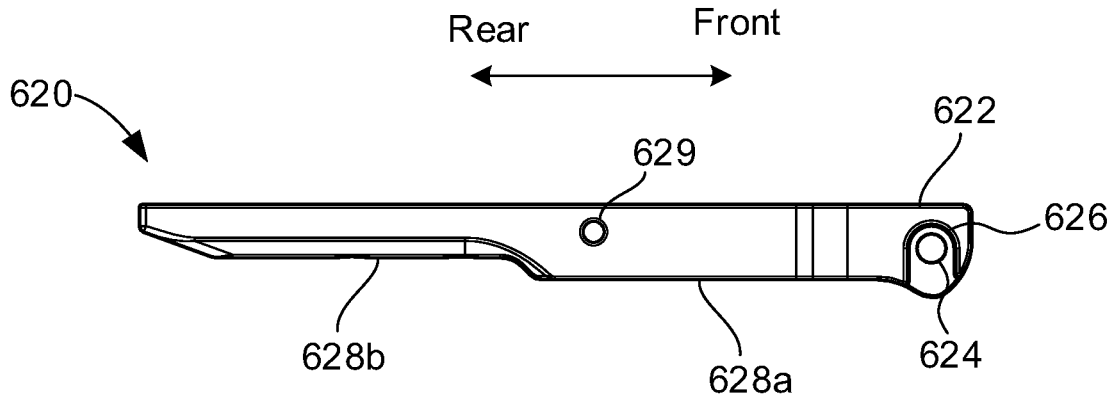
FIG. 25B is a side view of the adapter body of FIG. 25A.
Figure 25C:
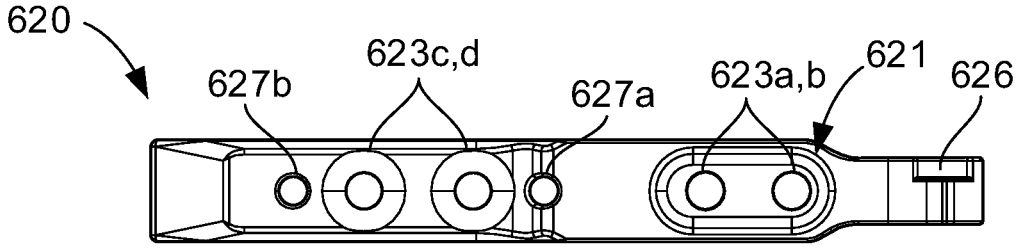
FIG. 25C is a bottom view of the adapter body of FIG. 25A.

Adapter body or universal block 620 is like adapter body 120 in that it generally forms a bottom side of mount adapter 610 when assembled. Also, adapter body 620 includes stepped or offset first and second bottom surfaces 628*a-b* for dust cover clearance, and a receptacle 621, as shown in FIG. 25C, which extends into first bottom surface 628*a* and is configured to receive a locking insert, such as inserts 130 and 230. It should also be understood that other embodiments of adapter body 620 may include an additional stepped surface like that of adapter body 220 to accommodate MOA shim 290. First and second smooth bores 623*a-b* also extend through adapter body 620 in a top to bottom direction so that they intersect receptacle 621 and form counterbores at a top side of adapter body 620. Such counterbores allow screws 640 to be sunk into adapter body 620 where the particular mount body that is attached to it does not overlap such bores 623*a-b*. Furthermore, adapter body 620 also includes a tang 622 with a threaded through-bore 624 and side notch 626 just like tang 222. Although not shown, tang 622 can also include a threaded bore adapted for receipt of micro front sight post 170.

Adapter body 620, at least because of its universality, includes a multitude of bores or openings which are not found on adapter body 220. This allows a variety of mount bodies, including mount body 612, to be connected to adapter body 620 without needing to disconnect adapter body from RSB 30. Such bores include third and fourth smooth bores 623*c-d* which also form counterbores in adapter body 620 like that of first and second bores 623*a-b*. However, the counterbores are formed in the bottom side within second bottom surface 628*b*. Another pair of threaded bores 627*a-b* flank third and fourth bore holes at opposed front and rear sides thereof, but do not have large countersink. Additionally, a pair of elongated pockets 625*a-b* extend from the top side of adapter body 620 and terminate within adapter body 620. Such elongated pockets 625*a-b* flank bores 627*a-b* at opposed front and rear sides thereof and have respective lengths that are perpendicular to each other. In this regard, the length of first elongated pocket 625*a* extends in a left-right direction, while the length of second elongated pocket 625*b* extends in a front-rear direction. A pair of side threaded bores 629 extend into adapter body 620 from opposing left and right locations and intersect first elongated pocket 625*a* so that set screws 603 can engage indentations 619 of lug 617*a* disposed therein. The bores/openings can have different arrangements than that shown and described. However, the arrangement described provides optimal functionality within a limited space. Also, depending on the application, more or less bores/openings can be provided in order to accommodate the desired mount body and firearm accessory. Thus, adapter body 620 can be longer or shorter as desired.

Locking insert 630 is that same as locking insert 130 or 230. However, any locking insert can be used in system 600.

System 600 can include the same hardware as systems 100 or 200. In this regard, system 600 includes flat head screws 640, push pivot pin 650, and shoulder bolt 660. However, system 600 also include additional threaded fasteners like retaining screws 603.

Figure 26A:
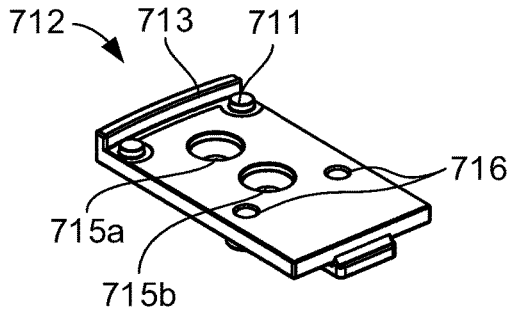
FIG. 26A is a top perspective view of a mount body according to another embodiment of the present disclosure.
Figure 26B:
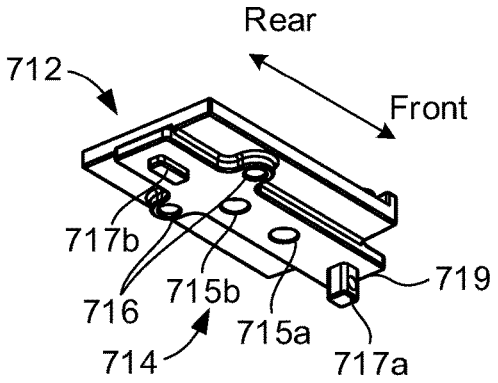
FIG. 26B is a bottom perspective view of the mount body of FIG. 26A.

FIG. 26A depicts a mount body 712 according to another embodiment of the present disclosure that can be used in system 600. Mount body 712 is in the form of a plate that has an optic specific interface which, for this embodiment, is a Trijicon RMR® pattern interface. Thus, mount body 712 has certain features, such as lugs 711 and threaded bores 716, that are configured to engage corresponding features of a Trijicon RMR® reflex optic and other optics that have adopted such a pattern. Mount body 712 also includes threaded through-bores 715*a-b*. However, bores 715*a-b* do not have large countersinks to ensure sufficient thread length. Threaded bores 715*a-b* are used to connect to bores 623*c-d* of adapter body 620 via flat head screws 640 driven through the bottom of adapter body 620 into mount body 712. As shown in FIG. 26B, a bottom side of mount body includes an adapter interface 714 that includes front and rear lugs 717*a-b* with indention cups 719, which are substantially the same as lugs of mount plate 612. Mount body 712 also includes a retention boss 713 intended to further secure the optic by acting as an abutment providing translational support, and generally follows the front profile shape of the optic being mounted.

Figure 27:
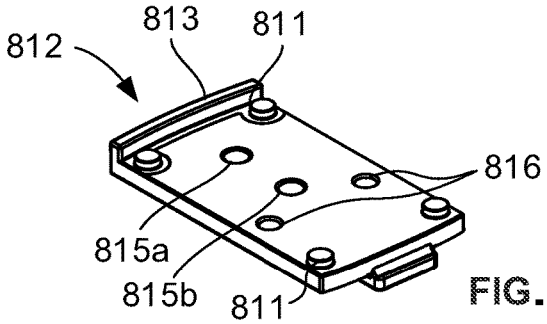
FIG. 27 is a top perspective view of a mount body according to a further embodiment of the present disclosure.

FIG. 27 depicts a mount body 812 according to a further embodiment of the present disclosure that can be used in system 600. Mount body 812 is like mount body 712 with the exception that its connection interface is adapted for a Docter® reflex optic. Thus, interface has certain features, such as lugs 811, support boss 813, and threaded bores 816, that are configured to engage corresponding features of a Docter® reflex optic. Mount body 812 also includes threaded bores 815*a-b* that are used to connect to bores 623*c-d* of adapter body 620 via flat head screws 640. However, bores 815*a-b* do not have large countersinks to ensure sufficient thread length. Thus, flat head screws 640 are driven through adapter body 620 and into mount body 812 from below in the same manner as mount body 712. The bottom side of mount body 812 includes an adapter interface like that of interface 714 of mount body 712 such that it includes front and rear lugs with indention cups, which are essentially the same as lugs 617*a-b* of mount plate 612.

Figure 28A:
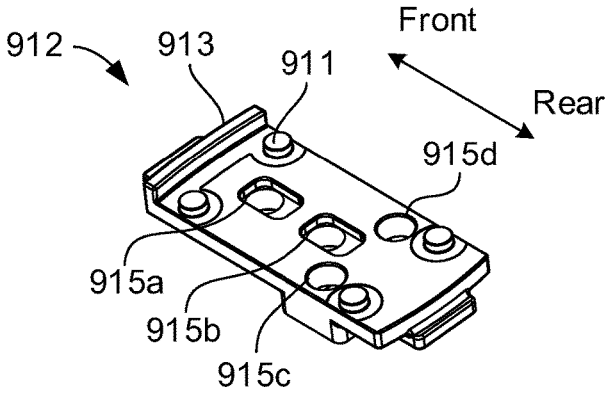
FIG. 28A is a top perspective view of a mount body according to yet another embodiment of the present disclosure.
Figure 28B:
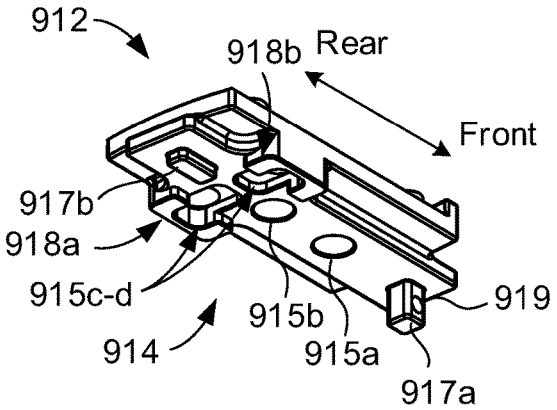
FIG. 28B is a bottom perspective view of the mount body of FIG. 28A.

FIGS. 28A and 28B depict a mount body 912 according to a yet further embodiment of the present disclosure that can be used in system 600. Mount body 912 is like mount body 712 with the exception that its connection interface is adapted for a Shield® reflex optic. Thus, interface has certain features, such as lugs 911 and that each have a circular aperture at a top side and a rectangular aperture at a bottom side of mount body 912, that are configured to engage L-nuts 930 and correspondingly engage features of a Shield® reflex optic, or the like. Mount body 912 also includes bores 915*a-b* that each have a circular aperture at a bottom side of mount body 912, as shown in FIG. 28B, and a rectangular aperture at a top side of mount body 912. As shown in FIG. 28B, the bottom side of mount body 912 includes an adapter interface 914 that includes front and rear lugs 917*a-b* with corresponding indention cups 919, which are substantially the same as lugs 617*a-b* of mount plate 612.

Figure 29:
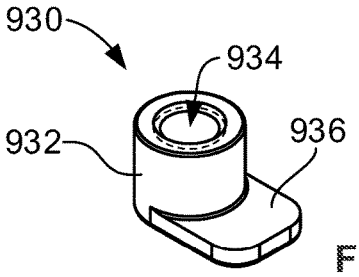
FIG. 29 is a perspective view of an L-nut for use with the mount body of FIG. 28A.

An L-nut 930, as shown in FIG. 29, includes a cylindrical body 932 with a threaded bore 934 extending therein and a rectangular foot 936 extending from body 932. L-nuts 930 can be installed into each bore 915*a-b* so that flat head screws 640 extending from adapter body 620 from below can engage cylindrical body 932.

As shown in FIGS. 30A-30E, L-nuts 930 may be used to secure mount body 912 to adapter body 620 with fasteners 640 extending through the bottom of holes 623*c-d* into aperture holes 915*a-b* and may also be used to secure the reflex optic 55 with fasteners 641 into aperture holes 915*c-d* engaging L-nuts 930.

Figure 30A:
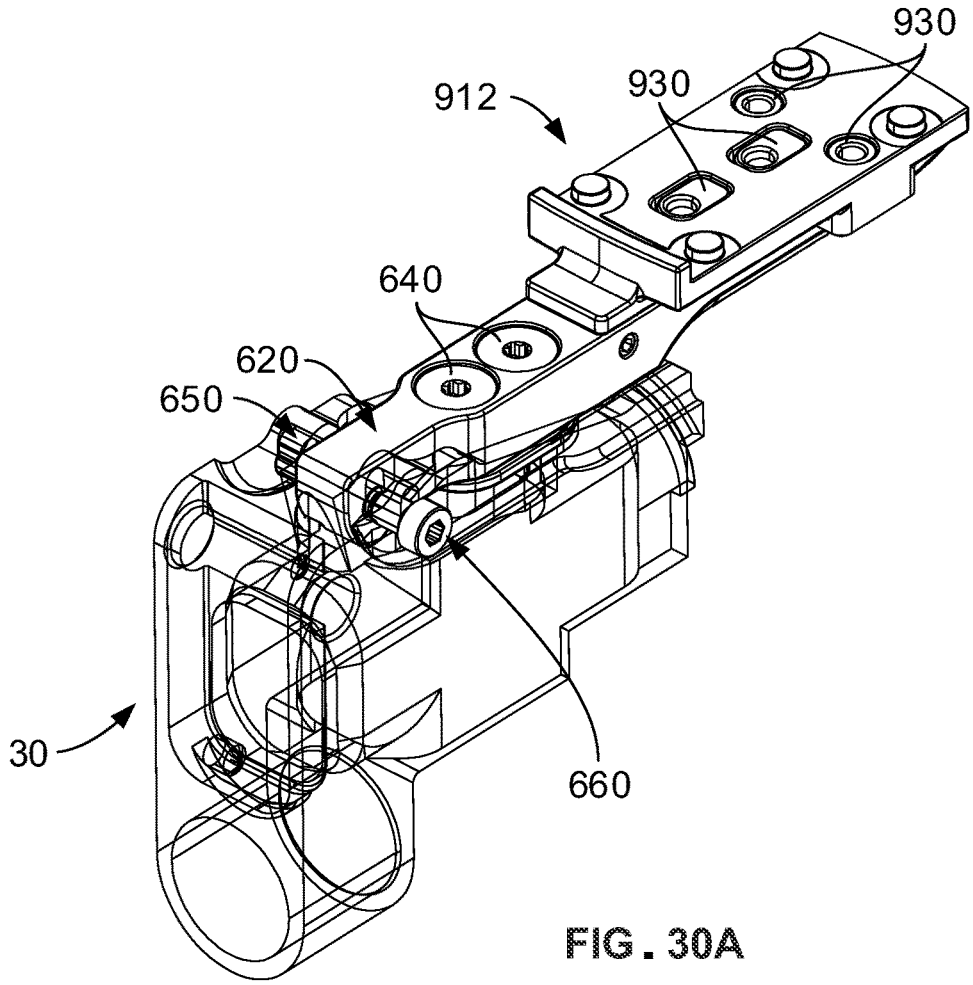
FIG. 30A is a top perspective view of an assembly including elements of FIGS. 28A and 25A.
Figure 30B:
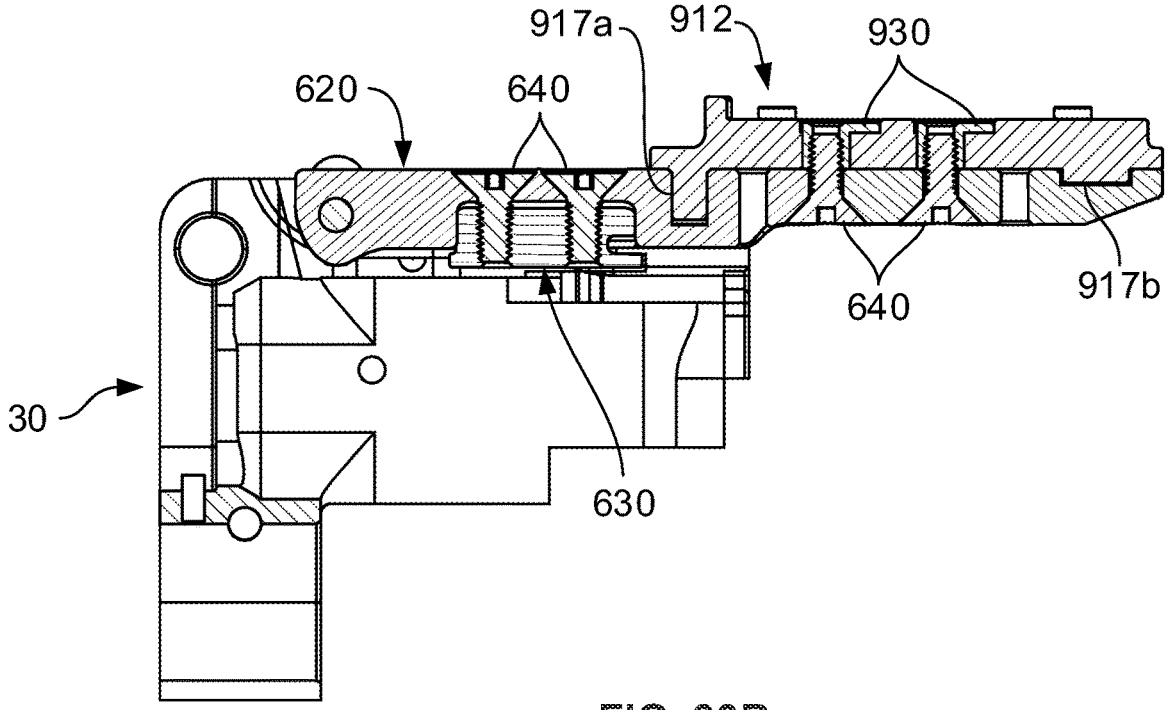
FIG. 30B is a side cross-sectional view of the assembly of FIG. 30A.
Figure 30C:
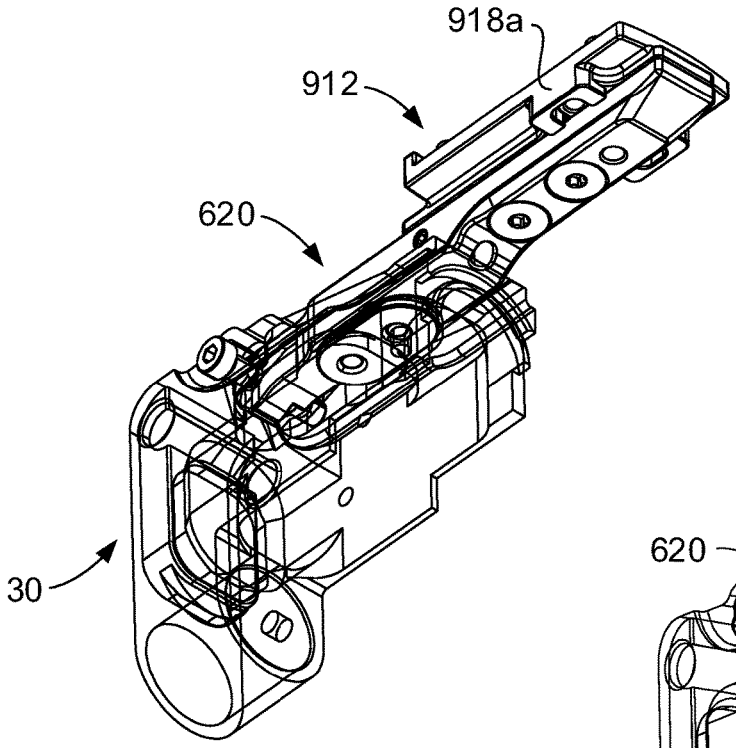
FIG. 30C is a bottom perspective view of the assembly of FIG. 30A.
Figure 30D:
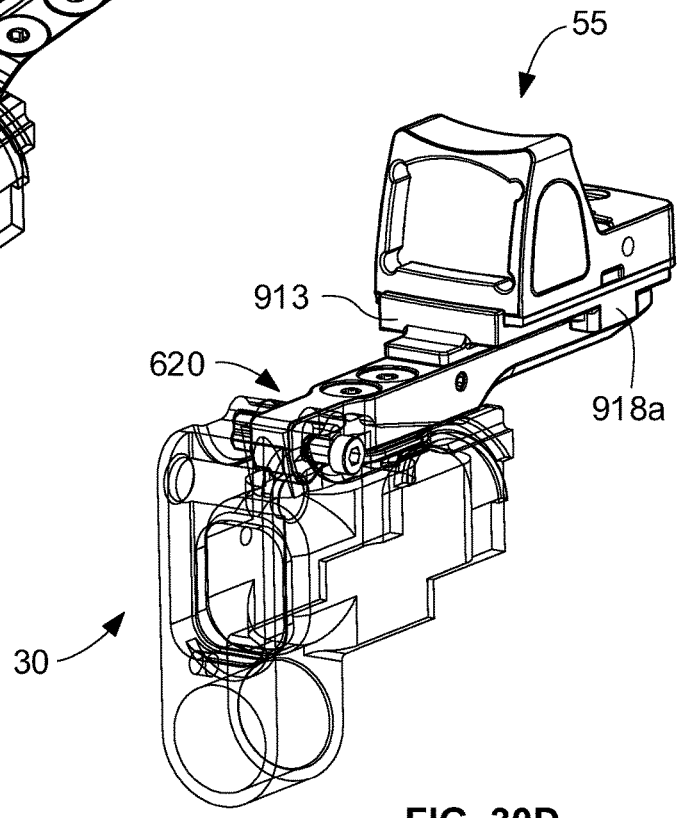
FIG. 30D is a side perspective view of the assembly of FIG. 30A including an optic mounted thereto.
Figure 30E:
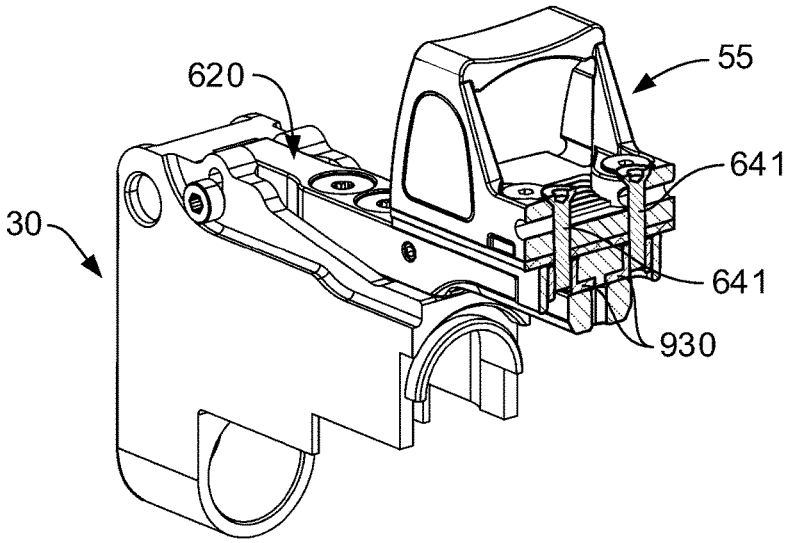
FIG. 30E is a rear perspective partial cross-section view of the assembly and optic of FIG. 30D.

System 600 is connected to RSB 30 of firearm 10 in a similar manner described above with respect to system 100. Additionally, because adapter body 620 is modular, any one of the aforementioned mount bodies 612, 712, 812, 912 can be connected to adapter body 620 which is generally performed using flat head screws 640, set screws 603, and L-nuts 930 as required. Additionally, the rectangular lugs 617*a-b*, 717*a-b*, 817*a-b*, 917*a-b* of the respective mount body 612, 712, 812, 912 are inserted into a respective elongated pockets 625*a-b*. For example, front lug 617*a* of mount body 612 is positioned within first elongated pocket 625*a*, while rear lug 617*b* is positioned in second elongated pocket 625*b*. The respective orientations of rectangular lugs 617*a-b* and elongated pockets 625*a-b* provides tight and loose tolerances in alternating orthogonal positions between each lug and pocket pairing. This facilitates easy insertion of lugs 617*a-b* into openings while simultaneously eliminating slop so that mount body 612 remains steadfast on adapter body 620. Set screws 603 engaging front lug 617*a* from right and left sides thereof to further secure mount body 612 so that it is immovably fixed to adapter body 620. Mount body 912 has two additional features, securing bosses 918*a-b*, which provide additional rigidity by re-enforcing boss 917*b*, by limiting side-to-side movement of surface 914 along top surface of adapter body 620, which is best illustrated in FIG. 30C.

FIGS. 31-37 depict accessory mount system 1000 according to further embodiment of the disclosure. System 1000 is like system 600 in that it includes a modular mount adapter 1010 formed of more than one component. Thus, for ease of review, like elements will be accorded like reference numerals to that of system 600, but within the 1000-series of numbers. However, while system 1000 is like that of system 600 in that it generally includes a modular mount adapter 1010, locking insert 1030, and hardware, system 600 differs with respect to its mount adapter 1010 and hardware. As explained further below, mount adapter 1010 includes a mount body 1012 that is elongated relative to mount bodies 112, 212, and 612 such that it bridges dust cover 20 of firearm 10 which allows a powered optic 60, such as the Trjicon ACOG® shown in FIG. 31, to be positioned closer to the operator's eye for desired eye-relief. A quick-connect mechanism is included in the hardware to facilitate quick removal and connection of mount body 1012 so that dust cover 20 can also be removed quickly and reconnected as needed for maintenance or otherwise.

Mount adapter 1010 is like mount adapter 610 in that it includes a separate mount body 1012 and adapter body 1020 that are capable of being connected together via reversible mechanical means. Such mechanical means can include, but are not limited to, a threaded fastener, pin, press-fit, snap-fit, heat-shrink fit, taper-lock, dovetail sliding fit, chemical adhesion and the like. However, in the embodiment depicted, a quick-connect mechanism is used to connect mount body 1012 and adapter body 1020 together, as discussed further below.

Figure 31:
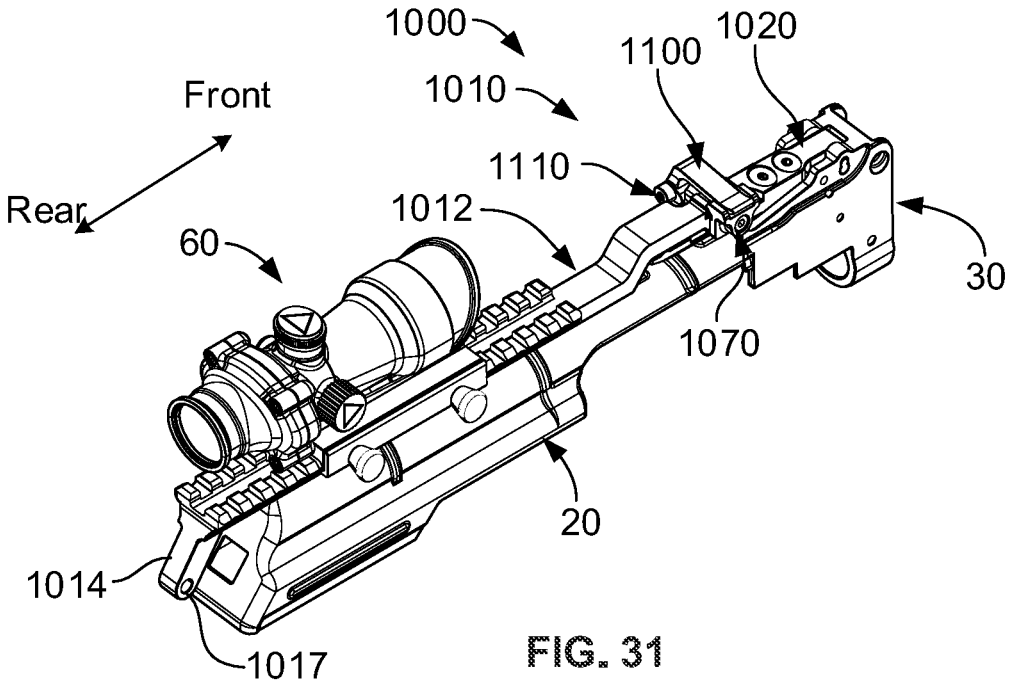
FIG. 31 is a top perspective view of an AMS according to an even further embodiment of the present disclosure as assembled with the RSB of FIG. 1C and a dust cover of the Kalashnikov firearm of FIG. 1A.
Figure 32A:
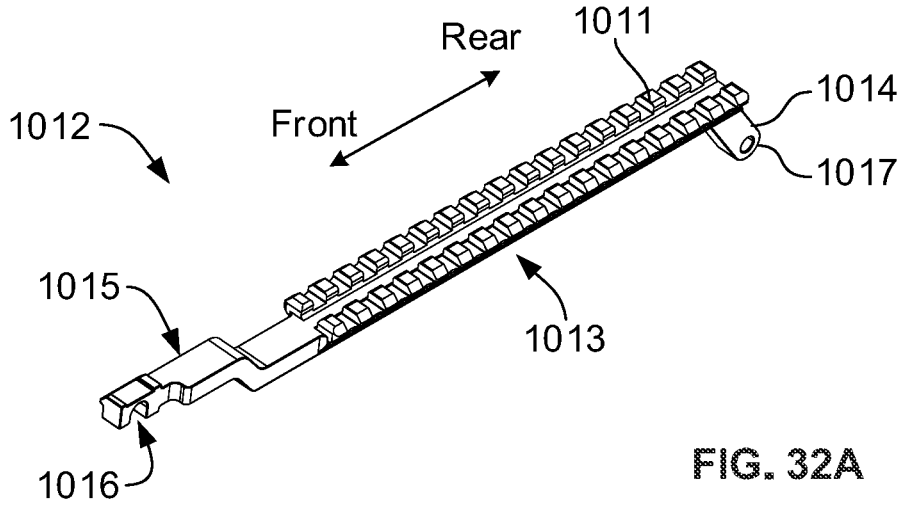
FIG. 32A is a perspective mount body of the AMS of FIG. 31.
Figure 32B:
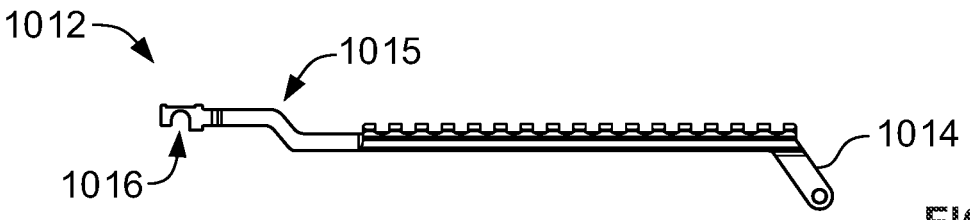
FIG. 32B is a side view of the mount body of FIG. 32A.
Figure 33:
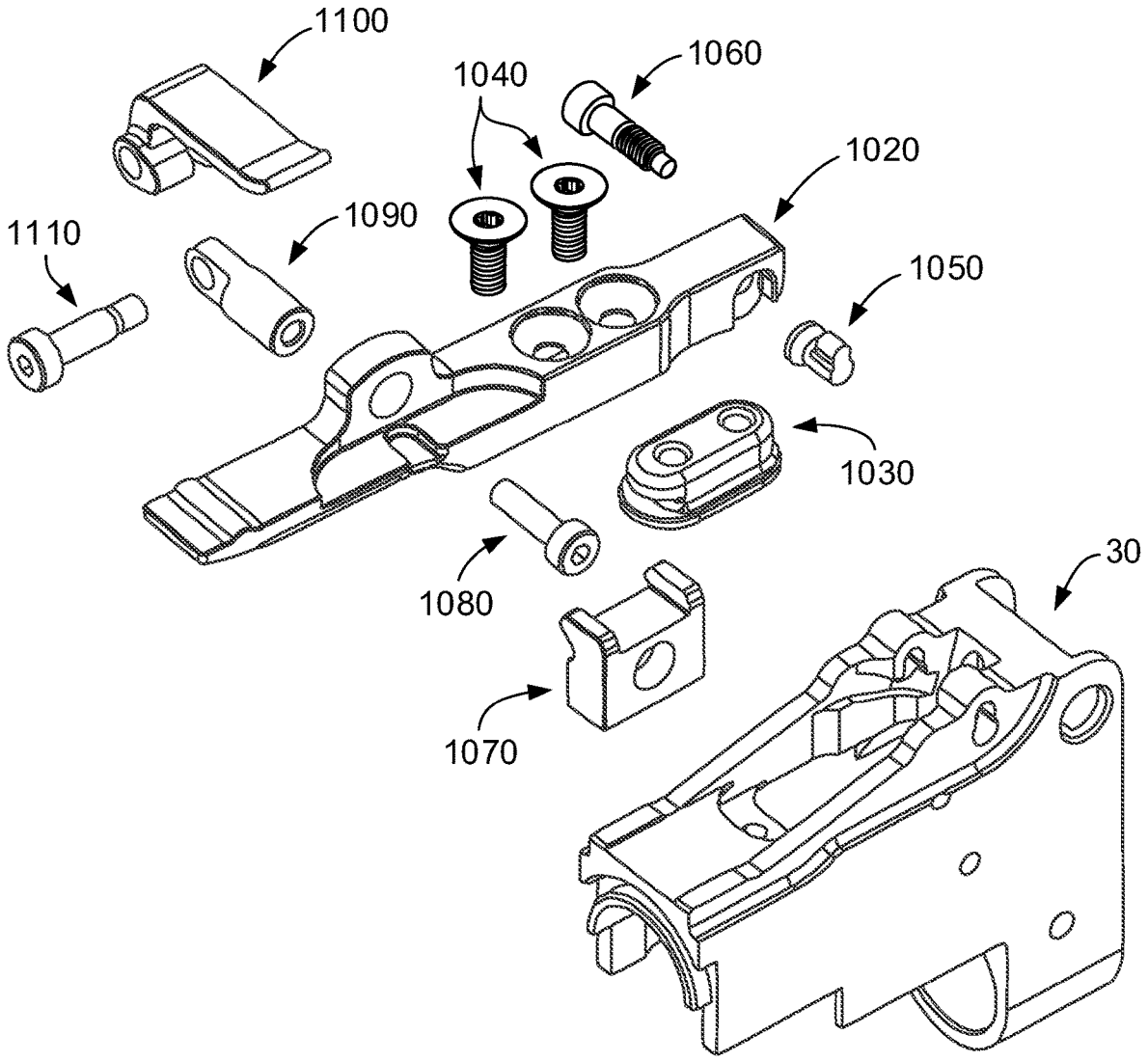
FIG. 33 is an exploded view of the RSB and AMS of FIG. 31 absent the mount body of FIG. 31.

As shown in FIGS. 32A and 32B, mount body or first body 1012 is like mount body 612 in that it includes an accessory interface that is adapted to receive and connect to a variety of accessories, such as sights, optics, lasers, lights, and the like. In this regard, the accessory interface of mount body 1012 is located on an interface portion or intermediate portion 1013 of mount body 1012 and includes a Picatinny rail 1011. It is also contemplated that interface portion 1013 can include any of the accessory interfaces described herein. However, mount body 1012 is more elongated than mount body 612 such that it has a length that is capable of extending from RSB 30 and over the entire dust cover 20, as illustrated in FIG. 31. Mount body 1012 also includes a first arm member 1014 and a second arm member 1015. First arm member 1014 is located at a rear end of mount body 1012 and extends downwardly at an oblique angle relative to the accessory portion 1013. A bore 1017 extends through first arm member 1014. Second arm member 1015 is located at a front end of mount body 1012 and is bent so that second arm member 1015 extends upwardly at an oblique angle and then frontwardly parallel with accessory portion 1013. Such bend allows interface portion 1013 of mount body 1012 to be positioned as close to dust cover 20 as possible so that interface portion has as low of a profile as possible. This helps keep an optic's height-over-bore as short as possible when mounted to interface portion 1013. Second arm member 1015 includes a notch 1016 through a bottom side thereof and at a front end of second arm 1015.

Figure 34A:
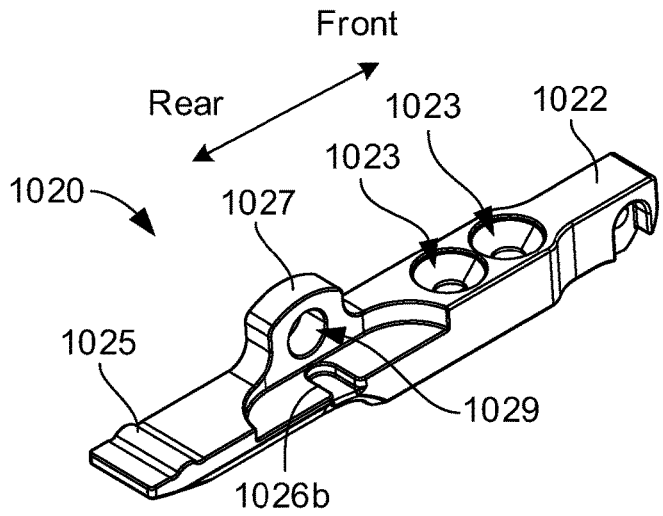
FIG. 34A is a top perspective view of an adapter body of the AMS of FIG. 31.
Figure 34B:
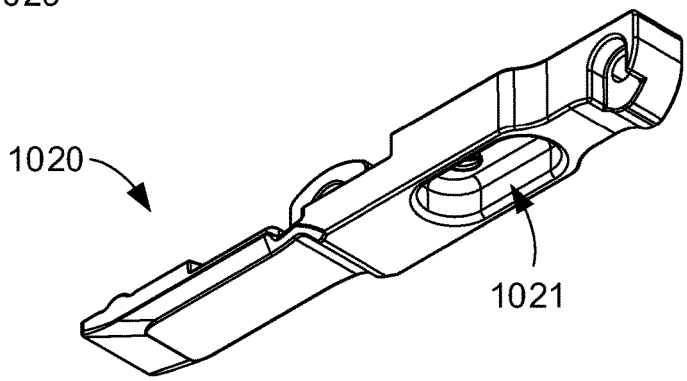
FIG. 34B is a bottom perspective view of the adapter body of FIG. 34A.
Figure 34C:
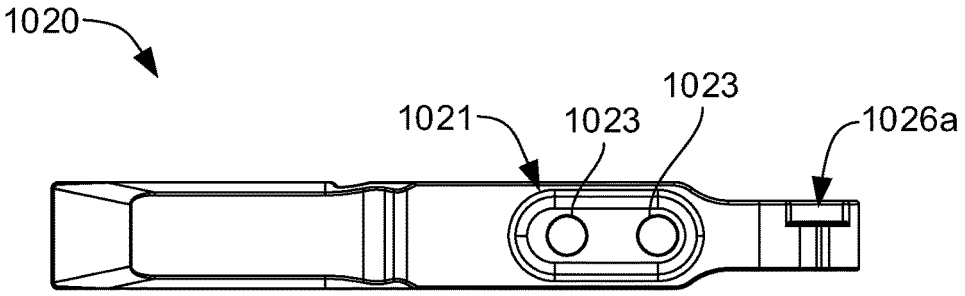
FIG. 34C is a bottom view of the adapter body of FIG. 34A.

FIGS. 34A-34D depicts adapter body or universal bridge block 1020. Adapter body 1020 like adapter body 620 in that it generally forms at least a portion of a bottom side of mount adapter 1010 when assembled. Also, adapter body 1020 includes stepped or offset first and second bottom surfaces 1028*a-b* for dust cover clearance, and a receptacle 1021, as shown in FIG. 34B, which extends into first bottom surface 1028*a* and is configured to receive any locking insert mentioned herein. It should also be understood that other embodiments of adapter body 1020 may include an additional stepped surface like that of adapter body 220 to accommodate MOA shim 290. Smooth bores 1023 also extend through adapter body 1020 in a top to bottom direction so that they intersect receptacle 1021 and form counterbores at a top end thereof. Such counterbores allow screws 1040 to be sunk into adapter body 1020 where the particular mount body that is attached so it does not overlap such bores 1023. Furthermore, adapter body 1020 also includes a tang 1022 or projection with a bore 1024 and side notch 1026*a* just like tang 622.

Figure 34D:
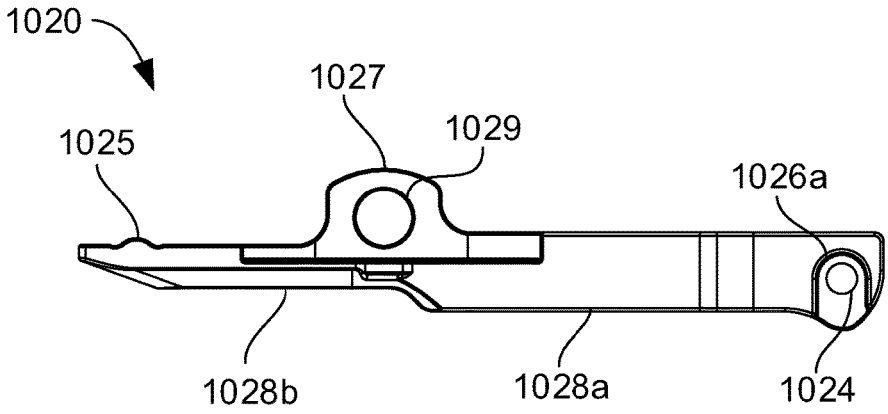
FIG. 34D is a side view of the adapter body of FIG. 34A.

Additionally, adapter body 1020 includes a flange 1027 and pedestal 1025 as best shown in FIGS. 34A and 34D. Flange 1027 extends upwardly from adapter body 1020 and has smooth bore 1029 that extends through flange 1027 in a right-left direction. Pedestal 1025 extends from a top side of adapter body 1020 and located rearward of flange 1027. Pedestal 1025 is generally cylindrical and creates an elevated structure for mount body 1012 to rest on. Because of the rounded character of pedestal 1025, line contact is formed between pedestal 1025 and a bottom surface of mount body 1012 which helps prevent wobble and ensures stability. A notch 1026*b* extends into a top side of mount body 1020 and in a right to left direction toward flange 1027.

Locking insert 1030 is that same as locking insert 230. However, it should be understood that other locking inserts adapted for a specific firearm can be used instead.

The hardware of system 1000, like system 600, includes flat head screws 1040, push pivot pin 1050, and shoulder bolt 1060. In addition, the hardware includes a quick-connect mechanism, which in the particular embodiment depicted is a clamping mechanism. The quick-connect mechanism includes a retention latch 1070, bolt 1080, retention clevis 1090, locking lever 1100, and locking pivot pin 1110.

Figure 35A:
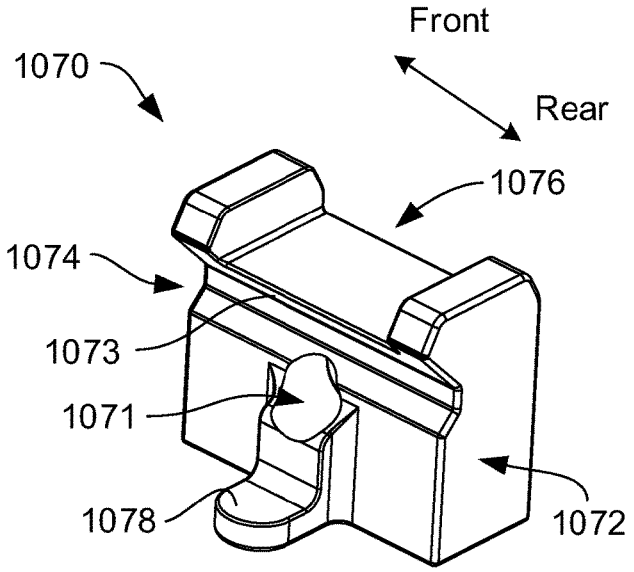
FIGS. 35A and 35B are top and bottom perspective views, respectively of a retention latch of the AMS of FIG. 31.
Figure 35B:
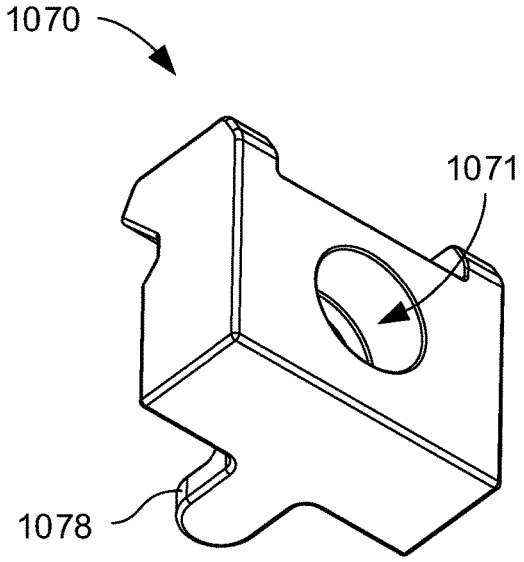

FIGS. 35A and 35B depict retention latch 1070 which generally includes a latch body 1072 and foot 1078 extending from latch body 1072 in a leftward direction. Foot 1078 is configured to be received within notch 1026*b* in adapter body 1020 and is slidable therein. A retention groove 1074 in a left face of latch body 1070 extends in a front-rear direction and partially defines a latch overhang 1073. A lever recess 1076 in a top side of latch body 1072 extends in a left-right direction and is configured to receive lever 1100. A smooth bore 1071 extends through retention latch body 1072 in a left right direction which has a greater cross-sectional dimension at one side of body 1072 than the other such that it forms a shoulder within body 1072 for abutment with a head of bolt 1080.

Figure 36:
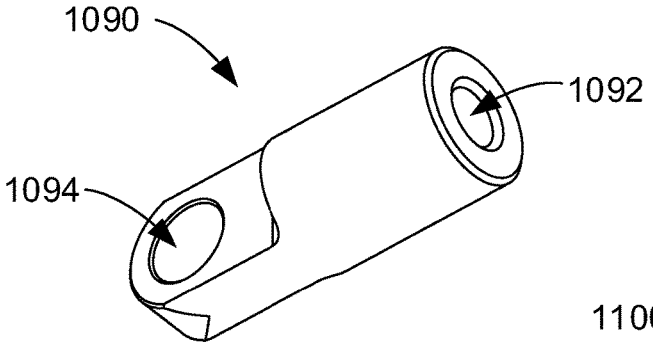
FIG. 36 is a perspective view of a retention clevis of the AMS of FIG. 31.

FIG. 36 depicts retention clevis 1090 which includes an axial bore 1092 extending therein and a transverse bore 1094 extending therethrough. Axial bore 1092 is threaded while transverse bore 1094 is a smooth bore. Retention clevis 1090 is cylindrical and is configured to slide in bore 1029 of adapter body 1020, and has a flat portion configured to slide into notch 1106 of lever 1100.

Figure 37:
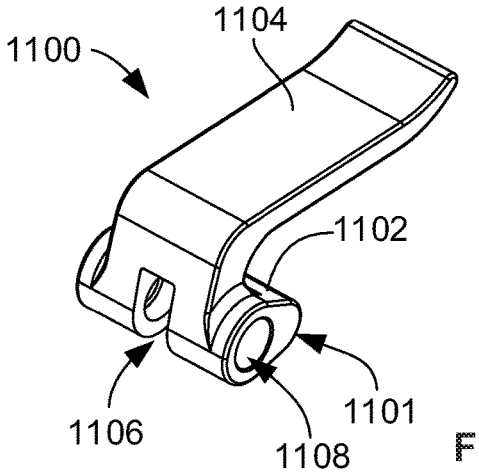
FIG. 37 is a perspective view of a locking lever of the AMS of FIG. 31.

FIG. 37 depicts locking lever 1100 comprised of a lever body 1101 and a lever arm 1104 extending from lever body 1101. A notch 1106 extends into lever body 1101 while a lever bore 1108 extends through lever body 1101 and intersects notch 1106. Lever body 1101 includes a cam surface 1102. Bore 1108 is smooth at a rear-side of gap 1106 but is threaded some distance past gap 1106 at a front side of gap 1106 which is used to threadably engage and retain the threaded end of locking pivot pin 1110.

While mount body 1012 is shown and described above to be connected via a quick-connect mechanism, it should be understood that mount body 1012 can be connected to adapter body 1020 and RSB 30 in any of the manners previously described.

System 1000 is connected to RSB 30 of firearm 10 in a similar manner described above with respect to system 600 particularly with respect to locking insert 1030 and adapter body 1020. However, unlike system 600, mount body 1012 is connected to adapter body 1020 using the quick-connect mechanism. In this regard, retention clevis 1090 is slidably positioned within bore 1029 of flange 1027 and also within slot 1106 of locking lever 1100 so that bores 1094 and 1108 align. Locking pivot pin 1110 is inserted through locking lever body 1100 and clevis 1090 to pivotably secure locking lever 1100 to clevis 1090. Bolt 1080 extends through bore 1071 of retention latch 1070 and is threadedly connected to bore 1092 of clevis 1090. Front arm member 1015 of mount body 1012 engages clevis 1090 with notch 1016 so that arm member 1015 is positioned between flange 1027 and retention latch 1070. Locking lever 1100 is then rotated which causes cam 1102 of locking lever 1100 to engage the other side of flange 1027 which subsequently pulls retention latch 1070 closer to flange 1027 thereby clamping mount body 1012 and fixedly secure it from movement. This quick connect mechanism can be adjusted as needed by rotating bolt 1080. When locking lever 1100 is moved to its locked position, lever arm 1104 is received within lever recess 1076 of latch 1070 to prevent it from accidentally disengaging. The cam surface 1102 is such that when the quick-connect mechanism is properly adjusted, lever 1100 is self-locking.

In this arrangement, mount body 1012 extends over dust cover 20, as shown in FIG. 31. This allows an optic 60, particularly one with magnification, to be placed as close to the rear end of dust cover 20 as possible to obtain proper eye-relief. Should firearm 10 need to be field-stripped, mount body 1012 can be quickly and easily removed by disengaging the quick-connect mechanism. Reassembly is just as quick and easy.

Figure 38A:
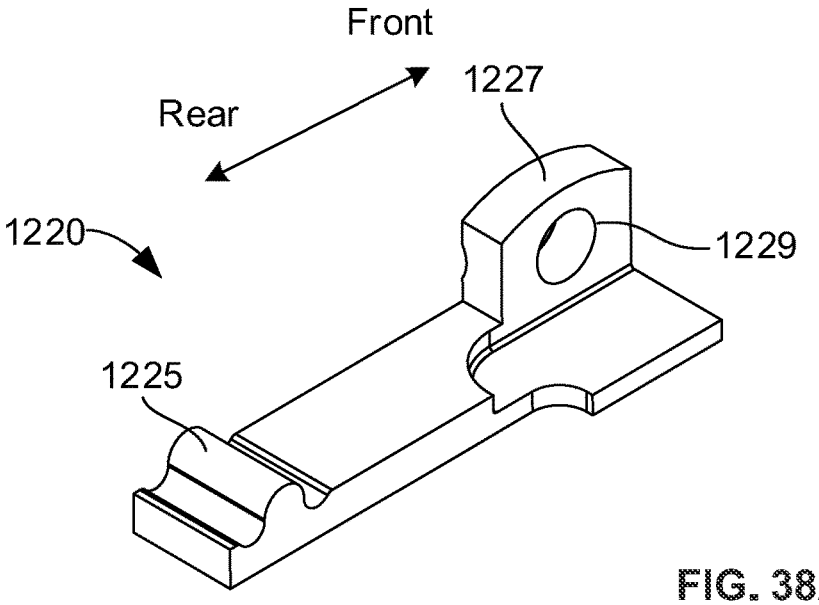
FIG. 38A is a top perspective view of an intermediate body according to an embodiment of the present disclosure.
Figure 38B:
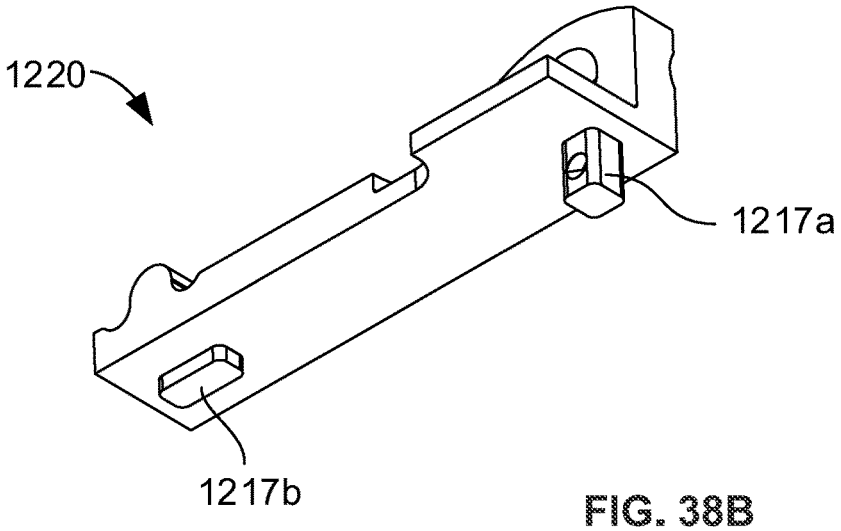
FIG. 38B is a bottom perspective view of the intermediate body of FIG. 38A.
Figure 38C:
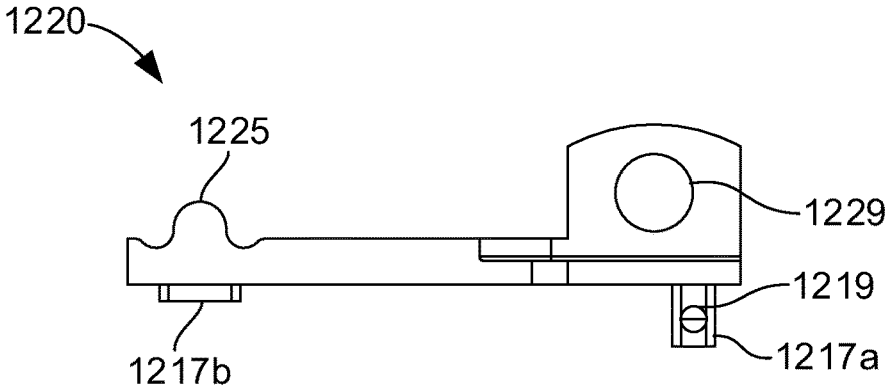
FIG. 38C is a side view of the intermediate body of FIG. 38A.

FIGS. 38A-38C depict an intermediate (IM) body 1220 according to an embodiment of the present disclosure. IM body 1220 can be connected to adapter body 620 in the same manner as the aforementioned mount bodies 612, 712, 812, 912. However, it does not have a mount interface. Instead, it has an adapter interface similar to that of adapter body 1020 for connection to bridging mount body 1012. In this regard, IM body 1220 includes a pedestal 1225 and flange 1227 with transverse bore 1229. Thus, in use, IM body 1220 is positioned between or intermediate adapter body 620 and mount body 1012.

The devices described herein may be made from metal, such as aluminum, steel, or stainless steel. However, some components, such as the alternative mount bodies and the micro front sight post, may be made with high temperature plastic.

FIGS. 39A-39E depict a mount adapter 1310 according to yet another embodiment of the present disclosure. For ease of review, like elements will be accorded like reference numerals to that of mount adapter 110, but within the 1300-series of numbers. For instance, mount adapter 1310 includes a mount body 1312 and an adapter body 1320. Additionally, mount adapter 1310 can be mounted to firearm 10 in the same manner as 110. In this regard, a user can optionally swap one out for the other with relative ease.

Figure 39A:
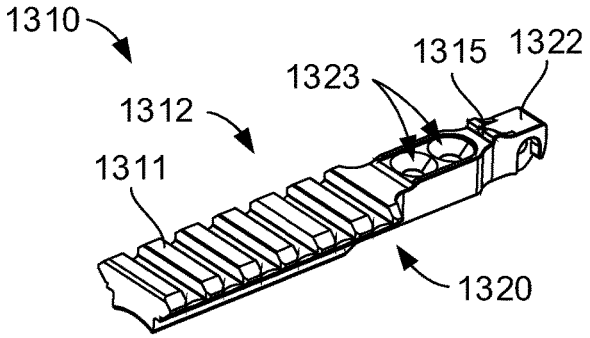
FIG. 39A is a top perspective view of a mount adapter according to another embodiment of the present disclosure.
Figure 39B:
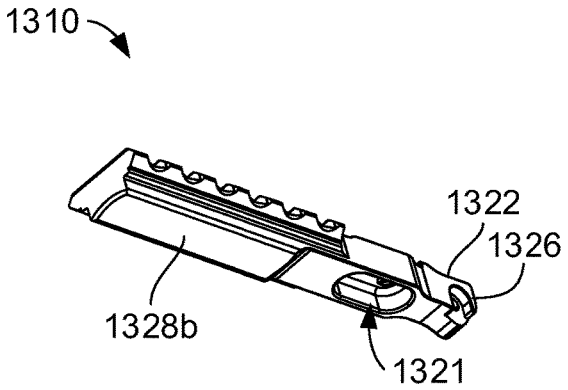
FIG. 39B is a bottom perspective view of the mount adapter of FIG. 39A.
Figure 39C:
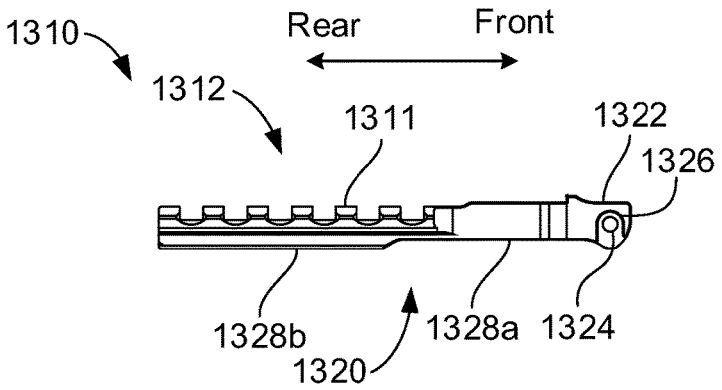
FIG. 39C is a side view of the mount adapter of FIG. 39A.
Figure 39D:
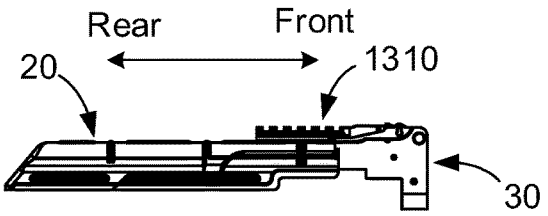
FIG. 39D is a side view an assembly that includes the mount adapter of FIG. 39A and the RSB and a dust cover of firearm of FIG. 1A.
Figure 39E:
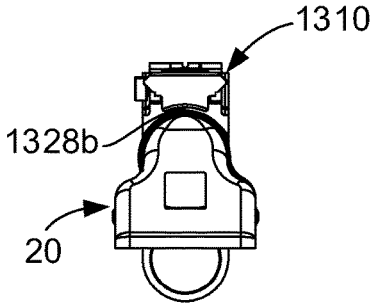
FIG. 39E rear view of the assembly of FIG. 39D.

However, mount adapter 1310 also differs from mount adapter 110. In particular, mount adapter 1310 is low-profile relative to mount adapter 110 in that the accessory interface, which in this particular embodiment includes the plurality of rails 1311, is positioned closer to dust cover 20 of firearm 10 than that of mount adapter 110, as illustrated in FIGS. 39D and 39E. So, while mount adapter 110 facilitates removal of dust cover 20 without an attendant removal of mount adapter 110, mount adapter 1310 trades off this functionality for a closer position relative to dust cover 20 and consequently also to barrel 14 potentially facilitating enhanced accuracy for a mounted optic at long ranges.

This low-profile is facilitated by a concave curvature in second bottom surface 1328*b* which corresponds to the convex curvature of dust cover 20, as shown in FIG. 39E. In other words, second bottom surface 1328*b* of adapter body 1320 is concavely curved in a plane transverse to a longitudinal axis of mount adapter 1310 so that mount adapter 1310 conforms to dust cover 20. Additionally, an upper extent of mount body 1312 is flush with or lower than an upper extent of tang 1322, as best shown in FIGS. 39C and 39D. This is in contrast to mount adapter 110 in which an upper extent of mount body 112 is higher than an upper extent of tang 122, as best shown in FIG. 3D. Also, because of the low-profile nature of mount adapter 1310, peep notch 1315 is positioned near the front end of mount adapter and extends upwardly from tang 1322, as shown in FIG. 39A.

Although the invention herein has been described with reference to particular embodiments, it is to be understood that these embodiments are merely illustrative of the principles and applications of the present invention. It is therefore to be understood that numerous modifications or combinations of features may be made to the illustrative embodiments and that other arrangements may be devised without departing from the spirit and scope of the present invention as defined by the appended claims.

The invention claimed is:

1. An accessory mount system for connection to a rear sight block (RSB) of a Kalashnikov pattern firearm, comprising:

a locking insert having a projection extending therefrom in a first direction, the projection configured to be directly received within a first recess of the RSB for connection thereto, wherein the RSB is configured to extend along a longitudinal axis of a barrel of a Kalashnikov pattern firearm;

an adapter body connected to the locking insert and having a projection extending therefrom in a second direction opposite the first direction, the projection of the adapter body being adapted to be received within a second recess of the RSB for connection thereto, the first and second directions extending along the longitudinal axis; and a mount body connected to the adapter body and having an accessory interface adapted to connect to an accessory, wherein the mount body is configured to extend over a receiver cover of the Kalashnikov pattern firearm.

2. The system of claim 1, wherein the locking insert includes a body that defines at least one screw bore extending therein in a third direction transverse to the first and second directions.

3. The system of claim 2, wherein the projection of the locking insert is a lip at least partially defined by a recess extending into the body of the locking insert.

4. The system of claim 1, wherein the locking insert includes a skirt extending outwardly from the body and defines a maximum perimeter of locking insert.

5. The system of claim 1, wherein the mount body is integrally connected to the adapter body such that they together form a monolithic structure.

6. The system of claim 1, wherein the mount body includes a plurality of lugs extending from a bottom side thereof and the adapter body defines a plurality of lug openings therein each configured to receive a respective one of the lugs.

7. The system of claim 1, wherein the adapter body includes a receptacle adapted to receive at least a portion of the locking insert therein.

8. The system of claim 7, wherein the adapter body includes a first bore extending therethrough and being in communication with the receptacle of the adapter body.

9. The system of claim 8, wherein the locking insert includes a second bore configured to align with the first bore of the adapter body when received within the receptacle of the adapter body.

10. The system of claim 1, wherein the adapter body includes a receptacle, and the locking insert includes a body that is received within the receptacle of the adapter body.

11. The system of claim 10, wherein the adapter body is connected to the locking insert via threaded fasteners extending through adapter body and into locking insert.

12. The system of claim 1, wherein the projection of the adapter body includes a bore and a side recess extending into a side of the projection and extending about the bore.

13. The system of claim 12, further comprising a push pivot pin and a fastener, the push pivot pin having a head adapted to be received within the side recess, the fastener being adapted to be received within the bore of the projection of the adapter body and engage the push pin.

14. The system of claim 1, wherein the projection of the adapter body is rotatably connectable to the RSB and the system further includes a shim adapted to be positioned between the adapter body and RSB to adjust an angle of an axis of the mount body relative to the RSB.

15. The system of claim 1, further comprising a front sight post connected to the adapter body and having a head and a tip extending from the head.

16. The system of claim 15, wherein the tip is eccentrically arranged on the head.

17. The system of claim 1, further comprising an L-Nut and the mount body having first and second bores each adapted to receive the L-Nut such that the first bore has a rectangular aperture at a top side of the mount body and a circular aperture at a bottom side of the mount body, and the second bore has a rectangular aperture at a bottom side of the mount body and a circular aperture at a top side of the mount body.

18. The system of claim 1, wherein the mount body includes an adapter interface defining a bottom surface opposite the accessory interface and a bore extending into the bottom surface, and the adapter body includes a bore extending through a bottom and top surface thereof such that, when the bore of the mount body aligns with the bore of the adapter body, a threaded fastener driven through the bore of the adapter body from the bottom to the top surface thereof engages the bore of the mount body.

19. An accessory mount system for connection to a rear sight block (RSB) of a Kalashnikov pattern firearm, comprising:

a locking insert having a body configured to be received within a receptacle of the Kalashnikov pattern firearm RSB and having a projection extending therefrom configured to directly engage the RSB from within its receptacle; and a mount adapter having a mount body and an adapter body, the mount body having an accessory interface forming at least a portion of a top side of the mount adapter, the adapter body forming at least a portion of a bottom side and a front end of the mount adapter, the bottom side being configured to connect to the locking insert, and the front end being configured to connect to the RSB, wherein the mount body is configured to extend over a receiver cover of the Kalashnikov pattern firearm.

20. An accessory mount system for connection to a rear sight block (RSB) of a Kalashnikov pattern firearm, comprising:

a locking insert having a body configured to be received within a receptacle of the Kalashnikov pattern firearm RSB and a projection extending from the body configured to directly engage the RSB from within its receptacle; and a mount adapter having a first end, a second end, accessory interface, and a receptacle, the accessory interface being configured to connect to an accessory, the receptacle of the mount adapter being configured to receive the locking insert therein for connection thereto, and the first end being configured to connect to the RSB, wherein the mount adapter is configured to extend over a receiver cover of the Kalashnikov pattern firearm.

* * * * *